US009939122B2

(12) United States Patent
Okubo et al.

(10) Patent No.: US 9,939,122 B2
(45) Date of Patent: Apr. 10, 2018

(54) VEHICLE HEADLAMP

(71) Applicant: ICHIKOH INDUSTRIES, LTD., Isehara-shi, Kanagawa-ken (JP)

(72) Inventors: Yasuhiro Okubo, Isehara (JP); Toshiya Abe, Isehara (JP); Kotoka Inoue, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 128 days.

(21) Appl. No.: 14/891,462

(22) PCT Filed: May 16, 2014

(86) PCT No.: PCT/JP2014/063044
§ 371 (c)(1),
(2) Date: Nov. 16, 2015

(87) PCT Pub. No.: WO2014/185510
PCT Pub. Date: Nov. 20, 2014

(65) Prior Publication Data

US 2016/0102831 A1 Apr. 14, 2016

(30) Foreign Application Priority Data

May 17, 2013 (JP) ..... 2013-105251
May 17, 2013 (JP) ..... 2013-105252
(Continued)

(51) Int. Cl.
*F21S 8/10* (2006.01)

(52) U.S. Cl.
CPC ..... *F21S 48/1721* (2013.01); *F21S 48/1104* (2013.01); *F21S 48/1154* (2013.01);
(Continued)

(58) Field of Classification Search
CPC ..... F21S 48/1721; F21S 48/1104; F21S 48/1275; F21S 48/1216; F21S 48/1715
(Continued)

(56) References Cited

U.S. PATENT DOCUMENTS 6,186,651 B1 * 2/2001 Sayers ..... F21S 48/1186 362/270
2003/0193813 A1 * 10/2003 Collins ..... F21S 48/1721 362/465
(Continued)

FOREIGN PATENT DOCUMENTS

EP S52-099031 A 8/1977
EP 1 126 210 A2 8/2001
(Continued)

OTHER PUBLICATIONS

Japanese Office Action dated Jan. 5, 2017 as issued in corresponding Japanese Application No. 2013-105404 and its English translation thereof.
(Continued)

*Primary Examiner* — Jong-Suk (James) Lee
*Assistant Examiner* — Christopher E Dunay
(74) *Attorney, Agent, or Firm* — Foley & Lardner LLP

(57) ABSTRACT

In vehicle headlamps of the prior art, a low-beam light distribution pattern and a high-beam distribution pattern could not be obtained in a direct illumination lens-type lamp unit. The present invention is provided with a semiconductor light source, a lens, a light control member, and a drive member. The lens is composed of a main lens section and an auxiliary lens section. The drive member positions the light control member in a first position and a second position in a moveable and switchable manner. Consequently, the present invention enables a low-beam light distribution pattern
(Continued)

and a high-beam light distribution pattern to be obtained in a direct illumination lens-type lamp unit.

23 Claims, 17 Drawing Sheets

(30) Foreign Application Priority Data

May 17, 2013 (JP) ..... 2013-105253
May 17, 2013 (JP) ..... 2013-105404

(52) U.S. Cl.
CPC ..... *F21S 48/1216* (2013.01); *F21S 48/1258* (2013.01); *F21S 48/1266* (2013.01); *F21S 48/1275* (2013.01); *F21S 48/325* (2013.01)

(58) Field of Classification Search
USPC ..... 362/465–468
See application file for complete search history.

(56) References Cited

U.S. PATENT DOCUMENTS

2003/0202358 A1* 10/2003 Albou ..... B60Q 1/14 362/510
2005/0270792 A1* 12/2005 Suzuki ..... F21S 48/1388 362/517
2006/0203503 A1* 9/2006 Casenave ..... F21S 48/1275 362/539
2007/0183168 A1* 8/2007 Naganawa ..... B60Q 1/085 362/545
2010/0165653 A1* 7/2010 Ookubo ..... F21S 48/1154 362/539
2012/0250338 A1* 10/2012 Fujiyoshi ..... B60Q 1/143 362/465
2013/0027961 A1* 1/2013 Ugajin ..... F21S 48/1154 362/538
2013/0128599 A1* 5/2013 Park ..... B60Q 1/08 362/466
2013/0163265 A1* 6/2013 Abe ..... F21V 1/00 362/512
2014/0092618 A1* 4/2014 Yagi ..... G02B 26/10 362/512
2015/0092436 A1* 4/2015 King ..... F21S 48/1747 362/513
2015/0167915 A1* 6/2015 Chiang ..... F21S 48/1131 362/513
2015/0184819 A1* 7/2015 Maliar ..... F21S 48/1154 362/512
2016/0298817 A1* 10/2016 Matsumoto ..... F21S 48/1159
2017/0009948 A1* 1/2017 Yagi ..... F21S 48/1225

FOREIGN PATENT DOCUMENTS

EP 1 818 601 A1 8/2007
EP 2 202 459 A1 6/2010
JP 2003-016813 A 1/2003
JP 2006-085922 A 3/2006
JP 2009-059617 A 3/2009
JP 2010-108844 A 5/2010
JP 2010-212089 A 9/2010
JP 2011-018574 A 1/2011
JP 2011-113732 A 6/2011
JP 2011-243474 A 12/2011
JP 2012-238477 A 12/2012
WO WO-2012/169117 A1 12/2012

OTHER PUBLICATIONS

Japanese Office Action dated Jan. 5, 2017 as issued in corresponding Japanese Application No. 2013-105251 and its English translation thereof.
Japanese Office Action dated Jan. 5, 2017 as issued in corresponding Japanese Application No. 2013-105253 and its English translation thereof.
Chinese Office Action dated May 27, 2017 as issued in corresponding Chinese Application No. 20148002555 and its English translation thereof.
Supplementary Partial European Search Report as issued in corresponding European Application No. EP 14 79 7041 dated Mar. 16, 2017.

* cited by examiner (A)

(B)

VEHICLE HEADLAMP

TECHNICAL FIELD

The present invention relates to a direct illumination lens-type vehicle headlamp which is capable of making light from a semiconductor light source incident to a lens and then from the lens, emitting two light distribution patterns, for example, a low-beam light distribution pattern and a high-beam light distribution pattern, toward a forward direction of a vehicle.

BACKGROUND ART

Vehicle headlamps of such a type are conventionally known (for example, Patent Literature 1 and Patent Literature 2). Hereinafter, the conventional vehicle headlamps will be described.

A conventional vehicle headlamp of Patent Literature 1 is provided with: a semiconductor light emitting element; a projection lens; a light guiding member; a movable light shading member; and an actuator to move the movable light shading member. In addition, in so far as the conventional vehicle headlamp of Patent Literature 1 is concerned, when the movable light shading member is positioned in a non-shading position, light from the semiconductor light emitting element is made incident to a respective one of the projection lens and the light guiding member; from the projection lens, the incident light is emitted toward a forward direction of a vehicle, as a light distribution pattern for side zone; and from the light guiding member, the incident light is emitted toward the forward direction of the vehicle, as light distribution patterns. Further, when the movable light shading member is positioned in a shading position, the light having been made incident from the semiconductor light emitting element to the light guiding member is shaded by the movable light shading member and thus from the projection lens, only the light distribution patterns for side zones are emitted toward the forward direction of the vehicle. In this manner, a high-beam light distribution pattern and a light distribution pattern for split high beam (a light distribution pattern for two-split high beam) are obtained.

A conventional vehicle headlamp of Patent Literature 2 is provided with: a light source; a lens; a first reflection surface; and a second reflection surface. In addition, in so far as the conventional vehicle headlamp of Patent Literature 2 is concerned, when the first reflection surface is positioned in an open position, light from the light source transmits the lens, and the thus transmitted light is emitted toward a forward direction of a vehicle, as a light distribution pattern for passing beam. Further, when the first reflection surface is positioned in a light shading position, the light from the light source is reflected on the first reflection surface, and the thus reflected light is reflected on the second reflection surface and then is emitted to the forward direction of the vehicle, as a light distribution pattern for cruising beam.

CITATION LIST

Patent Literature

Patent Literature 1: Japanese Unexamined Patent Application Publication No. 2010-212089
Patent Literature 2: Japanese Unexamined Patent Application Publication No. 2011-113732

SUMMARY OF THE INVENTION

Problems to be Solved by the Invention

However, the conventional vehicle headlamp of Patent Literature 1 emits a light distribution pattern for center zone of high-beam light distribution patterns from the light guiding member and thus this headlamp cannot be applied to a lamp unit of such a type that the light from the semiconductor light emitting element is made incident to the projection lens, and from the projection lens, the incident light is emitted toward the forward direction of the vehicle, as a respective one of the two light distribution patterns, for example, the light distribution pattern for passing and the light distribution pattern for cruising beam (a direct illumination lens-type lamp unit). In addition, in so far as the conventional vehicle headlamp of Patent Literature 2 is concerned, means for forming a light distribution pattern for cruising beam are a first reflection surface and a second reflection surface and thus this headlamp cannot be applied to a lamp unit of such a type that the light from the semiconductor light source is made incident to a lens and then from the lens, the incident light is emitted toward the forward direction of the vehicle, as two light distribution pattern, for example, a light distribution pattern for passing beam and a light distribution pattern for cruising beam (a direct emission lens-type lamp unit).

A problem to be solved by the present invention is that, in the conventional vehicle headlamps, in the direct emission lens-type lamp unit, the two light distribution patterns, for example, the low-beam light distribution pattern and the high-beam light distribution pattern are not obtained.

Means for Solving the Problem

In a first aspect, a vehicle headlamp comprising: a semiconductor light source; a lens to emit light from the semiconductor light source toward a forward direction of a vehicle, as a respective one of a first light distribution pattern and a second light distribution pattern; a light control member; and a drive member to position the light control member to be switchable in movement between a first location and a second location, wherein the lens is composed of a main lens section and an auxiliary lens section, and wherein, when the light control member is positioned in the first location that is a location between the semiconductor light source and the auxiliary lens section, the lens emits the first light distribution pattern toward the forward direction of the vehicle, and when the light control member is positioned between the second location that is a location between the semiconductor light source and the main lens section, the lens emits the second light distribution pattern toward the forward direction of the vehicle, respectively.

In a second aspect, the vehicle headlamp according to claim 1, wherein the light control member comprises a variable focal point lens section to displace, to an upper side, a focal point of the auxiliary lens section when positioned in the first location, with respect to a focal point of the auxiliary lens section when positioned in the second location.

In a third aspect, the vehicle headlamp, wherein the light control member rotates between the first location and the second location by way of the drive member, and a rotation center of the light control member is positioned at a rear side more significantly than a light emission surface of the semiconductor light source.

In a fourth aspect, the vehicle headlamp, wherein the auxiliary lens section is disposed at a lower side with respect to the main lens section.

In a fifth aspect, the vehicle headlamp, wherein the light control member and the auxiliary lens section that are positioned in the first location partially overlap each other on top and bottom.

In a sixth aspect, a vehicle headlamp comprising: a semiconductor light source; a lens to emit light from the semiconductor light source toward a forward direction of a vehicle, as a respective one of a first light distribution pattern and a second light distribution pattern; a light control member; and a drive member to position the light control member to be switchable in movement between a first location and a second location, wherein the lens is composed of a main lens section and an auxiliary lens section, wherein, when the light control member is positioned in the first location that is a location between the semiconductor light source and the auxiliary lens section, the lens emits the first light distribution pattern toward the forward direction of the vehicle, and when the light control member is positioned between the second location that is a location between the semiconductor light source and the main lens section, the lens emits the second light distribution pattern toward the forward direction of the vehicle, respectively, and wherein, when the light control member is positioned in the first location, a portion which is positioned at the main lens section's side, of the light control member, displaces a focal point of the main lens section to a lower side.

In a seventh aspect, the vehicle headlamp, wherein the light control member rotates between the first location and the second location by way of the drive member, and a rotation center of the light control member is positioned at a rear side more significantly than a light emission surface of the semiconductor light source.

In an eighth aspect, the vehicle headlamp, wherein the auxiliary lens section is disposed at a lower side with respect to the main lens section.

In a ninth aspect, the vehicle headlamp, wherein the light control member and the auxiliary lens section that are positioned in the first location partially overlap each other on top and bottom.

In a tenth aspect, a vehicle headlamp comprising: a semiconductor light source; a lens to emit light from the semiconductor light source toward a forward direction of a vehicle, as a respective one of a first light distribution pattern and a second light distribution pattern; a light control member; and a drive member to position the light control member to be switchable in movement between a first location and a second location, wherein, when the light control member is positioned in the first location that is a location between the semiconductor light source and the auxiliary lens section, the lens emits the first light distribution pattern toward the forward direction of the vehicle, and when the light control member is positioned in the second location that is a location between the semiconductor light source and the main lens section, the lens emits the second light distribution pattern to the forward direction of the vehicle, respectively, wherein a focal point of an upper portion of the light control member is displaced to an upper side or a lower side with respect to a focal point of another portion, and wherein a focal point of a lower portion of the light control member is displaced to a lower side or an upper side with respect to the focal point of another portion.

In an eleven aspect, the vehicle headlamp, wherein a focal point of an intermediate portion between upper and lower sides of the light control member is neither displaced to the upper side nor the lower side.

In a twelve aspect, the vehicle headlamp, wherein of the light control member, when positioned in the first location, a focal point of a portion which is at an optical axis's side of the main lens section is displaced to a lower side with respect to a focal point of another portion, and of the light control member, when positioned in the first location, a focal point of a portion opposite to the optical axis's side of the main lens section is displaced to an upper side with respect to the focal point of said another portion.

In a thirteen aspect, the vehicle headlamp, wherein the light control member rotates between the first location and the second location by way of the drive member, and a rotation center of the light control member is positioned at a rear side more significantly than a light emission surface of the semiconductor light source.

In a fourteen aspect, the vehicle headlamp, wherein the auxiliary lens section is disposed at a lower side with respect to the main lens section.

In a fifteen aspect, the vehicle headlamp, wherein the light control member and the auxiliary lens section that are positioned in the first location partially overlap each other on top and bottom.

In a sixteen aspect, a vehicle headlamp comprising: a semiconductor light source; a lens to emit light from the semiconductor light source toward a forward direction of a vehicle, as a respective one of a first light distribution pattern and a second light distribution pattern; a light control member; and a drive member to position the light control member to be switchable in movement between a first location and a second location, wherein, when the light control member is positioned in the first location that is a location between the semiconductor light source and the auxiliary lens section, the lens emits the first light distribution pattern toward the forward direction of the vehicle, and when the light control member is positioned in the second location that is a location between the semiconductor light source and the main lens section, the lens emits the second light distribution pattern to the forward direction of the vehicle, respectively, and wherein the light control member is composed of a light transmission member, and comprises a variable focal point lens and a mounting section.

In a seventeen aspect, the vehicle headlamp, wherein between the variable focal point lens section and the mounting section, a fixed focal point lens section is provided.

In a eighteen aspect, the vehicle headlamp, wherein between the variable focal point lens section and the fixed focal point lens section, a gradually variable focal point lens section is provided.

In a nineteen aspect, the vehicle headlamp, wherein of the light control member, at least a surface opposing to the semiconductor light source of the mounting section forms a concave surface which is recessed with respect to the semiconductor light source, and at least an opposite surface to the surface opposing to the semiconductor light source of the mounting section forms a convex surface which protrudes to an opposite side to the semiconductor light source.

Effect of the Invention

According to the vehicle headlamp of the first to fifth inventions, when a light control member is positioned in a first location, most of light from a semiconductor light source is directly made incident to a main lens section of a lens, and a part of the light from the semiconductor light source is made incident to an auxiliary lens section of the lens via the light control member and then from the lens, a first light distribution pattern is emitted to a forward direction of a vehicle. In addition, when the light control member is positioned in a second location, a part of the light from the semiconductor light source is made incident to the main lens section of the lens via the light control member, and the residue of the light from the semiconductor light source is directly made incident to the auxiliary lens section of the lens and then from the lens, a second light distribution pattern is emitted to the forward direction of the vehicle. As a result, in the direct emission lens-type lamp unit, two light distribution patterns, for example, a low-beam light distribution pattern and a high-beam light distribution pattern are reliably obtained.

According to the vehicle headlamp of the sixth to ninth inventions, when the light control member is positioned in the first location, most of the light from the semiconductor light source is directly made incident to the main lens section of the lens, and a part of the light from the semiconductor light source is made incident to the auxiliary lens section of the lens and then from the lens, the first light distribution pattern, for example, the low-beam light distribution pattern is emitted toward the forward direction of the vehicle. At this time, of the light control member, a focal point of a portion which is at an optical axis's side of the main lens section is displaced to a lower side with respect to a focal point of another portion. Thus, of the light control member, the emitted light having been emitted from the portion that is the optical axis's side of the main lens section is obtained as downward emitted light. In this manner, due to a dimensional tolerance and mounting distortion or the like of components, even if the emitted light having been emitted from the portion that is the optical axis's side of the main lens section, of the light control member, is made incident to the main lens section in place of the auxiliary lens section, the emitted light having been emitted from the main lens section is oriented downward, and is obtained as a part of the first light distribution pattern. As a result, generation of stray light can be prevented.

According to the vehicle headlamp of the tenth to fifteenth inventions, when the light control member is positioned in the second location, most of the light from the semiconductor light source is made incident to the main lens section of the lens via the light control member, and a part of the light from the semiconductor light source is directly made incident to the auxiliary lens section of the lens and then from the lens, the second light distribution pattern, for example, the high-beam light distribution pattern is emitted toward the forward direction of the vehicle. At this time, a focal point of an upper portion of the light control member is displaced to an upper side or a lower side with respect to a focal point of another portion. Thus, the emitted light having been emitted from the upper portion of the light control member is obtained as upward emitted light or downward emitted light. On the other hand, a focal point of a lower portion of the light control member is displaced to the lower side or the upper side with respect to a focal point of another portion. Thus, the emitted light having been emitted from the lower portion of the light control member is obtained as downward emitted light or upward emitted light. In this manner, the upward emitted light having been emitted from the light control member transmits the main lens section of the lens and then is deflected upward, whereas the downward emitted light having been emitted from the light control member transmits the main lens section of the lens and then is deflected downward. As a result, the second light distribution pattern, for example, the light from the upper portion of the high-beam light distribution pattern is sufficiently obtained, and the visibility of a traffic sign (an overhead sign), a tree, a pedestrian or the like can be enhanced. In addition, the second light distribution pattern, for example, the light from the lower portion of the high-beam light distribution pattern is sufficiently obtained, missing of a part of the light distribution is prevented, splitting of the light distribution is eliminated, continuity of the light distribution is improved, and the visibility in a lateral direction from a front side of the vehicle can be enhanced. Therefore, a good second light distribution pattern, for example, a high-beam light distribution pattern is obtained.

According to the vehicle headlamp of the sixteenth to nineteenth inventions, by a variable focal point lens section of the light control member, at the time of emission of the second light distribution pattern, the high-beam light distribution pattern, it is possible to deflect a part of the first light distribution pattern, for example, of the low-beam light distribution pattern, or alternatively, at the time of emission of the first light distribution pattern, for example, the low-beam light distribution pattern, and it is also possible to deflect a part of the second light distribution pattern, for example, of the high-beam light distribution pattern. In this manner, the second light distribution pattern and the first light distribution pattern can be emitted with high precision.

MODE FOR CARRYING OUT THE INVENTION

Hereinafter, embodiments (examples) of a vehicle headlamp according to the present invention will be described in detail with reference to the drawings. It is to be noted that the present invention is not limited by the embodiments. In FIG. 6, FIG. 7, FIG. 20, FIG. 21, FIG. 22, and FIG. 25, reference sign "VU-VD" designates a vertical line from the top to the bottom of a screen. Reference sign "HL-HR" designates a horizontal line from the left to the right of the screen. In addition, FIG. 6, FIG. 7, FIG. 20, FIG. 21, FIG. 22, and FIG. 25 are explanatory views of equi intensity curves of light briefly showing light distribution patterns on the screen mapped by computer simulation. In the explanatory views of the equi intensity curves of light, a central equi intensity of curve of light indicates high intensity of light, and an outside equi intensity of curve of light indicates low intensity of light. Further, FIG. 8 is an explanatory view of isolux curves of light simplifying and showing light distribution patterns on the road mapped by computer simulation. In the explanatory view of the isolux curves, a central isolux curve indicates high luminance, and an outside isolux curve indicates low luminance. A numeric unit is based on "m". Furthermore, in FIG. 4, FIG. 5, FIG. 9, FIG. 10, FIG. 12, FIG. 13, FIG. 14, and FIG. 17, hatching of cross sections of a lens and a light control member is not shown. In the specification, the front, rear, top, bottom, left, and right are respectively equivalent to the front, rear, top, bottom, left, and right when the vehicle headlamp according to the present invention is mounted on a vehicle.

(Description of Configuration of First Embodiment)

Figure 1:
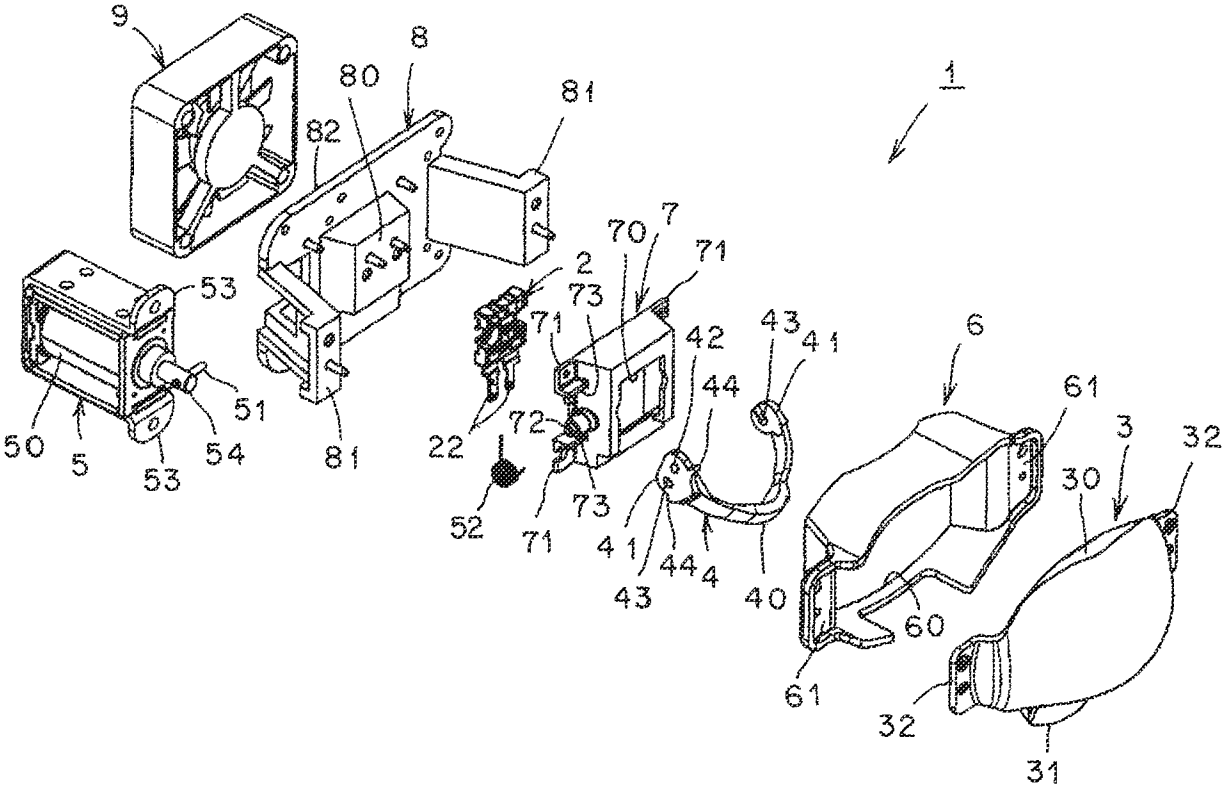
FIG. 1 is an exploded perspective view of essential constituent elements of a lamp unit showing a first embodiment of a vehicle headlamp according to the present invention.

FIG. 1 to FIG. 11 each show a first embodiment of the vehicle headlamp according to the present invention. Hereinafter, a configuration of the vehicle headlamp according to the first embodiment will be described. In FIG. 1, reference numeral 1 designates the vehicle headlamp according to the first embodiment (such as a headlamp). The vehicle headlamp 1 is mounted at each of the left and right end parts of a front part of a vehicle C.

(Description of Lamp Unit)

Figure 2:
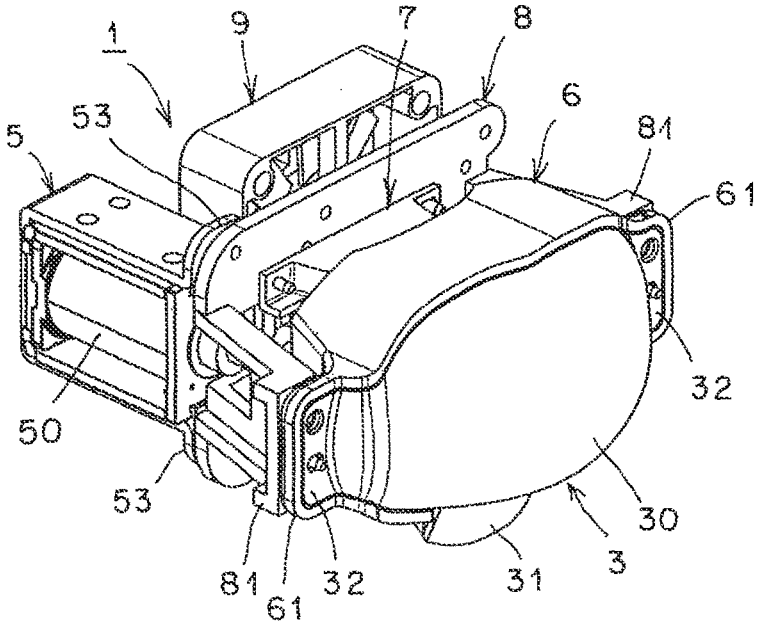
FIG. 2 is a perspective view showing the lamp unit.
Figure 3:
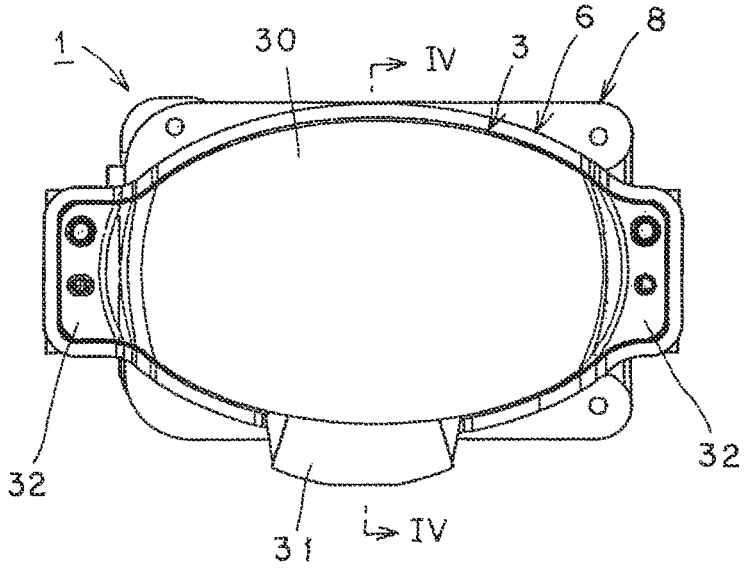
FIG. 3 is a front view showing the lamp unit.

The vehicle headlamp 1, as shown in FIG. 1 to FIG. 3, is provided with: a lamp housing (not shown); a lamp lens (not shown); a semiconductor light source 2; a lens (a fixed lens) 3; a light control member (a movable lens) 4; a drive member 5; a lens covering member 6; a bearing member 7; a base member 8; and a cooling member 9.

The semiconductor light source 2, the lens 3, the light control member 4, the drive member 5, the lens covering member 6, the bearing member 7, the base member 8, and the cooling member 9 constitute a lamp unit. The lamp housing and the lamp lens define a lamp room (not shown). The lamp unit formed by the constituent elements 2, 3, 4, 5, 6, 7, 8, and 9 is disposed in the lamp room, and is mounted to the lamp housing via an optical axis adjustment mechanism for vertical direction (not shown) and an optical axis adjustment mechanism for transverse direction (not shown).

(Description of Semiconductor Light Source 2)

The semiconductor light source 2, as shown in FIG. 1, FIG. 4, FIG. 5, and FIG. 9 to FIG. 11, in this example, is a self-emission semiconductor light source such as an LED, an OEL, or an OLED (an organic EL), for example. The semiconductor light source 2 is composed of: a light emitting chip (an LED chip) 20; a package (an LED package) to seal the light emitting chip 20 with a sealing resin member; a board 21 to implement the package; and a connector 22 which is mounted to the board 21 and supplies a current from a power source (a battery) to the light emitting chip 20. It is to be noted that, in FIG. 4, FIG. 5, FIG. 9 to FIG. 11, and FIG. 13 and FIG. 14, the illustration of the connector 22 is omitted.

The board 21 is positioned at a light source mounting section 80 of the base member 8 by way of a positioning hole and a positioning pin, and is mounted to the light source mounting section 80 of the base member 8 by way of a screw or the like. As a result, the semiconductor light source 2 is mounted to the base member 8.

The light emitting chip 20, in this example, forms a planar rectangular shape (a planar rectangle shape). That is, four square chips are arrayed in the X-axis direction (a horizontal direction). It is to be noted that two, three, or five or more square chips or one rectangular chip, or one square chip may be used. A front face of the light emitting chip 20, in this example, a front face of a rectangle forms a light emission surface 23. The light emitting surface 23 is oriented to a front side of a reference optical axis (a reference axis) Z of the lens 3. A center O of the light emission surface 23 of the light emitting chip 20 is positioned at or near a reference focal point of the lens 3, and is positioned on or near the reference optical axis Z of the lens 3.

In the figures, the axes X, Y, and Z constitute a rectangular coordinate (an X-Y-Z rectangular coordinate system). The X-axis is a horizontal axis in the transverse direction passing through the center O of the light emission surface 23 of the light emitting chip 20, and in the first embodiment, the right side is in a positive direction and the left side is in a negative direction. In addition, the Y-axis is a vertical axis in the vertical direction passing through the center O of the light emission surface 23 of the light emitting chip 20, and in the first embodiment, the upper side is in a positive direction, and the lower side is in a negative direction. Further, the Z-axis is a normal line (a perpendicular line) passing through the center O of the light emission surface 23 of the light emitting chip 20, that is, is an axis in the longitudinal direction orthogonal to the X-axis and the Y-axis, and in the first embodiment, the front side is in a positive direction, and the rear side is in a negative direction.

(Description of Lens 3)

The lens 3 is composed of a light transmission member. The lens 3, as shown in FIG. 1 to FIG. 5, FIG. 9, and FIG. 10, is composed of a main lens section 30; an auxiliary lens section (an additional lens section) 31; and a mounting section 32. It is to be noted that the double-dotted chain line in FIG. 9 indicates a boundary between the main lens section 30 and the auxiliary lens section 31. The mounting section 32 is integrally provided at each of the left and right end parts of the main lens section 30. The mounting section 32 is positioned to a lens mounting section 81 of the base member 8 by way of a positioning hole and a positioning pin or the like via the lens covering member 6, and is mounted to the lens mounting section 81 of the base member 8 by way of a screw or the like. As a result, the lens 3 is mounted to the base member 8 via the lens covering member 6. Although the mounting section 32, in this example, is an integral structure with the lens 3, this mounting section may be a separate structure from the lens 3.

Figure 6:
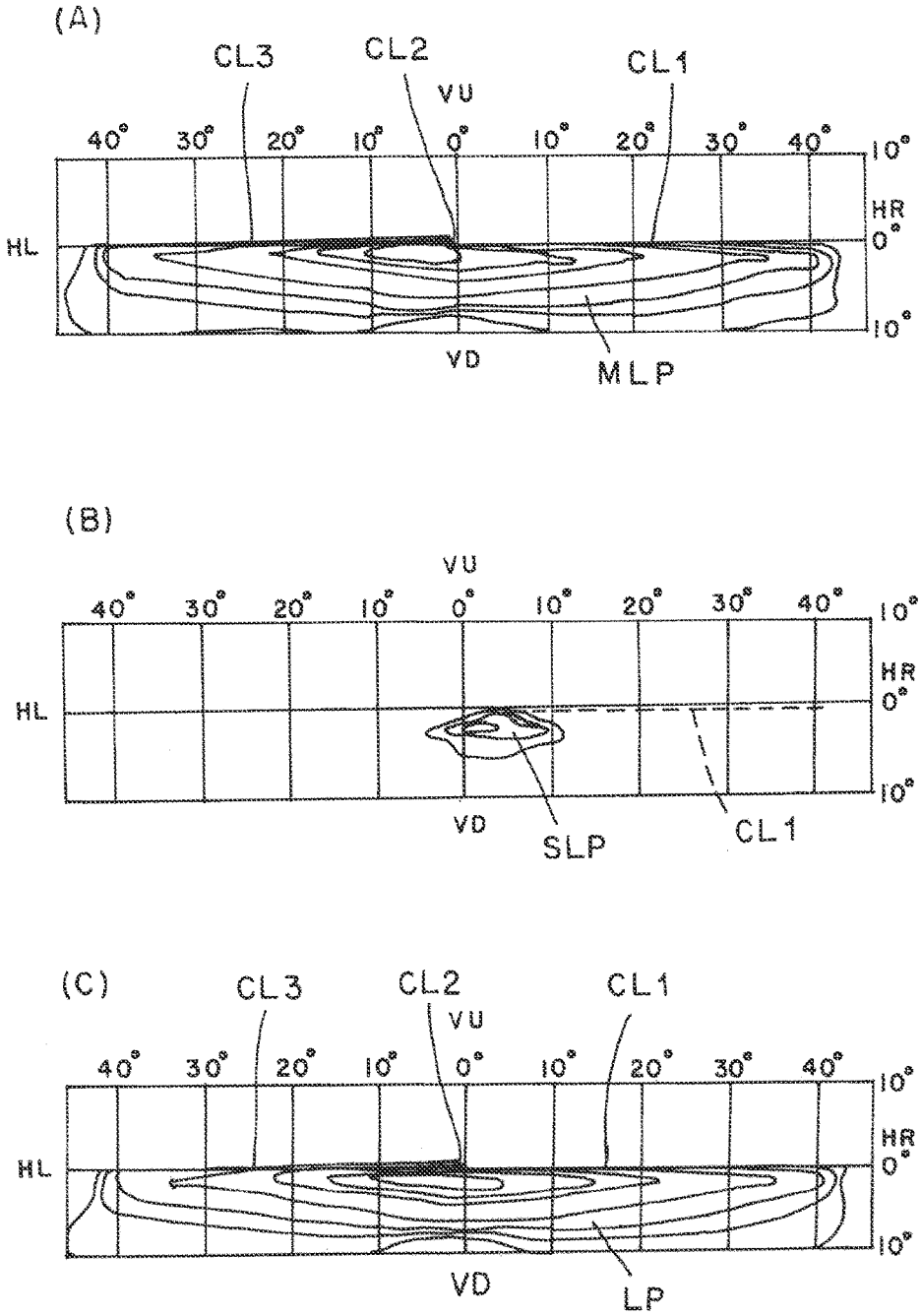
FIG. 6 is an explanatory view of an equi-intensity curve of light showing a low-beam light distribution pattern.
Figure 7:
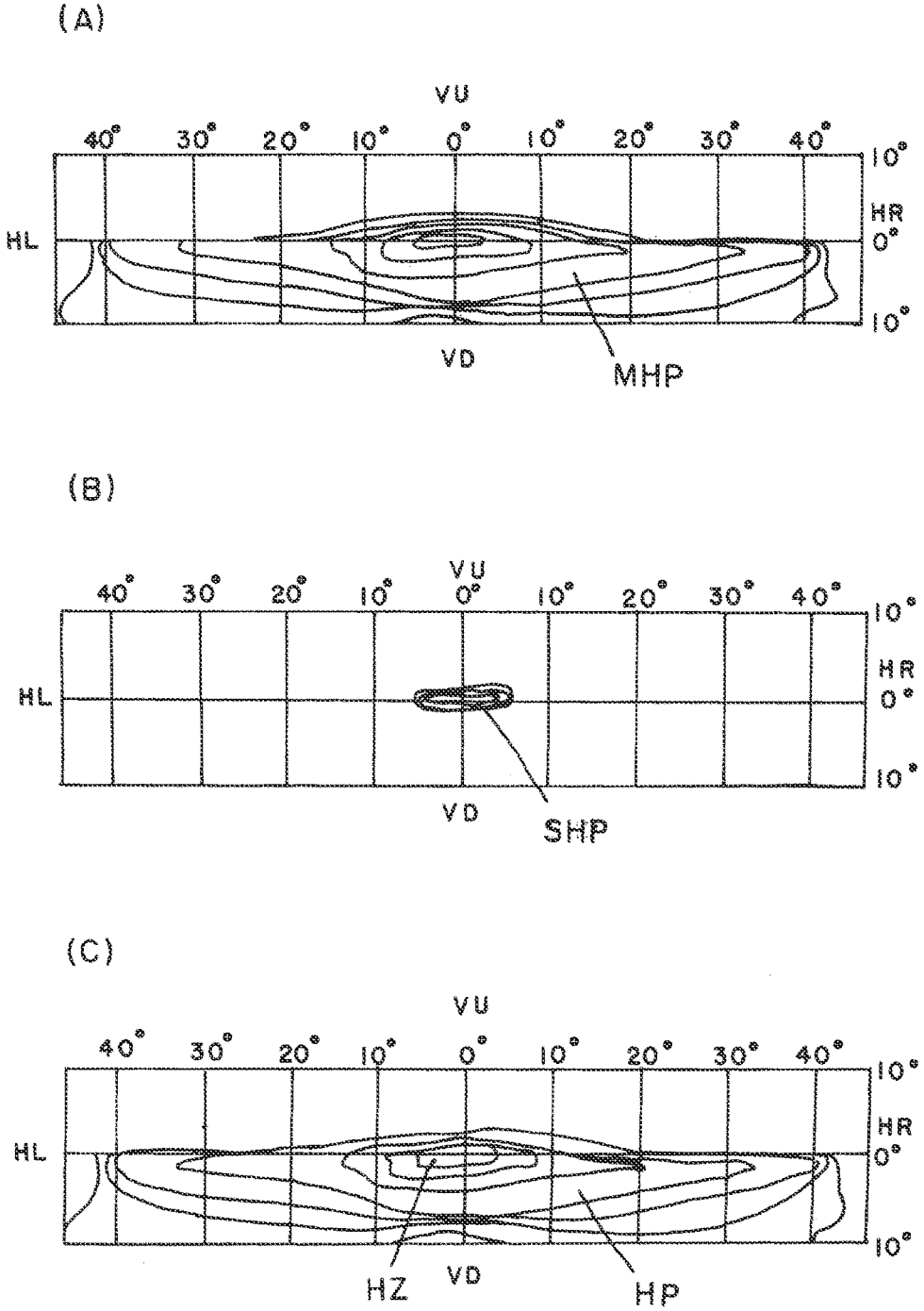
FIG. 7 is an explanatory view of an equi-intensity curve of light showing a high-beam light distribution pattern.
Figure 8:
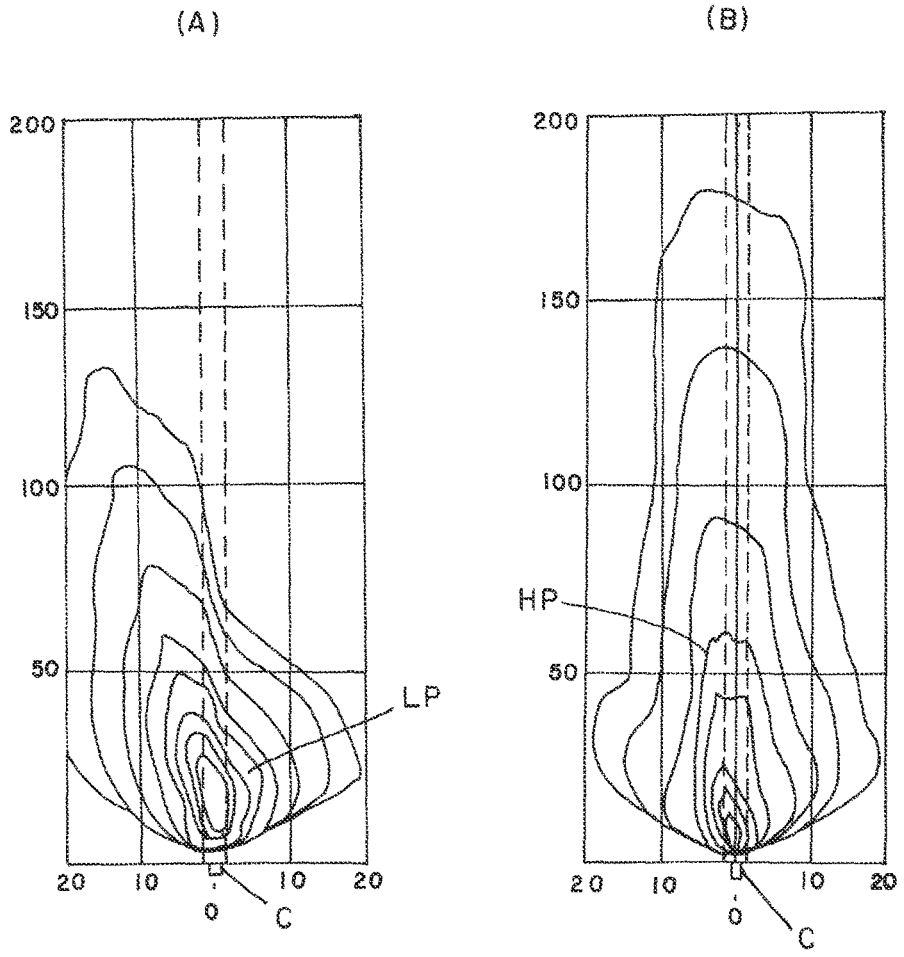
FIG. 8 is an isolux curve showing the low-beam light distribution pattern and the high-beam light distribution pattern.

The lens 3 emits the light from the semiconductor light source 2 toward a forward direction C of a vehicle, as a low-beam light distribution pattern (a light distribution pattern for passing) LP as a first light distribution pattern shown in FIG. 6 (C) and FIG. 8 (A) and a high-beam light distribution pattern (a light distribution pattern for cruising) HP as a second light distribution pattern shown in FIG. 7 (C) and FIG. 8 (B). The low-beam light distribution pattern LP has a lower horizontal cutoff line CL1, an oblique cutoff line CL2, and an upper cutoff line CL3. The high-beam light distribution pattern HP has a hot zone (a high intensity of light zone) HZ at a central portion thereof.

(Description of Main Lens Section 30)

Figure 4:
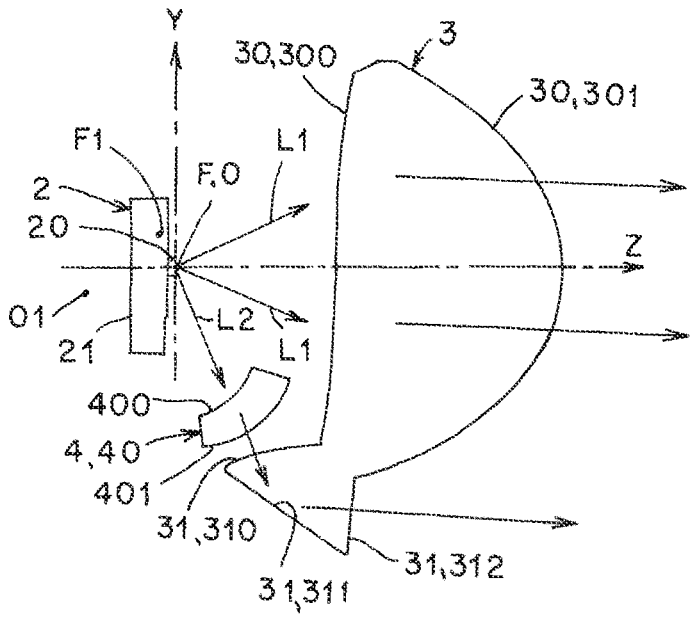
FIG. 4 is a sectional view showing an optical path when a light control member is positioned in a first location (an explanatory view corresponding to the sectional view taken along the line IV-IV in FIG. 3).
Figure 5:
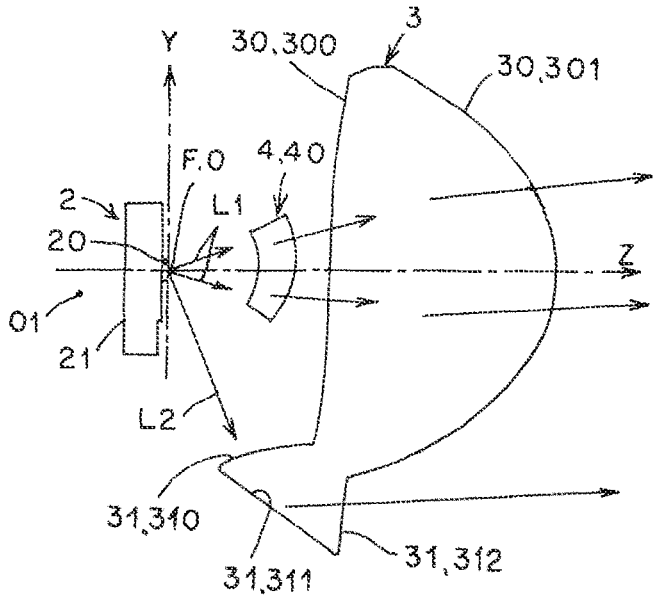
FIG. 5 is a sectional view showing an optical path when the light control member is positioned in a second location (an explanatory view corresponding to the sectional view taken along the line IV-IV in FIG. 3).

The main lens section 30, as shown in FIG. 4 and FIG. 5, has the reference optical axis Z and the reference focal point F. The main lens section 30 utilizes center light L1 and a part of the peripheral light, of the light, that are radiated from the semiconductor light source 2. The center light L1 is light in a range of a predetermined angle (in this example, about 60 degrees) or less from the X-axis or the Y-axis of a hemispheric radiation range of the semiconductor light source 2, the light being made incident to a central portion of the main lens section 30. In addition, the peripheral light is light in a range of a predetermined angle (in this example, about 60 degrees) or less from the X-axis or the Y-axis in the hemispheric radiation range of semiconductor light source 2. A part of the peripheral light is light which is made incident to the peripheral part of the main lens section 30, of the peripheral light. The main lens section 30, in this example, is a transmission-type lens section to transmit the light from the semiconductor light source 2.

The main lens section 30 emits the light from the semiconductor light source 2 (the center light L1 and a part of the peripheral light) to the forward direction of the vehicle C, as a main light distribution pattern (a basic light distribution pattern), in the first embodiment, as a main light distribution pattern MLP of a low-beam light distribution pattern shown in FIG. 6 (A) and a main light distribution pattern MHP of a high-beam light distribution pattern shown in FIG. 7 (A). That is, the main lens section 30 emits the light that is directly made incident from the semiconductor light source 2 (the center light L1 and a part of the peripheral light), toward the forward direction of the vehicle C, as the main light distribution pattern MLP of the low-beam light distribution pattern, and emits: the light having transmitted the light control member 4 from the semiconductor light source 2 (the center light L1 and a part of the peripheral light in the X-axis direction); and the light that is directly made incident from the semiconductor light source 2 (a part of the residual peripheral light other than a part of the peripheral light in the X-axis direction), toward the forward direction of the vehicle C, as the main light distribution pattern MHP of the high-beam light distribution pattern.

The main lens section 30 is composed of an incidence surface 300 to which the light from the semiconductor light source 2 is made incident into the main lens section 30; and an emission surface 301 from which the light having been made incident into the main lens section 30 is emitted. The incidence surface 300 of the main lens section 30 is composed of a free curved surface or a composite quadratic curved surface. The emission surface 301 of the main lens section 30 forms a convex shape which protrudes to an opposite side to the semiconductor light source 2, and is composed of a free curved surface or a composite quadratic curved surface.

(Description of Auxiliary Lens Section 31)

Figure 9:
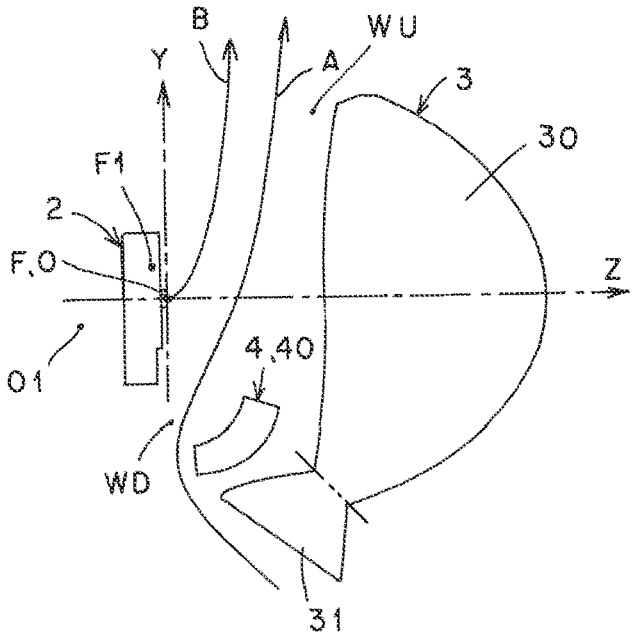
FIG. 9 is an explanatory view showing a radiant heat and a heat convection of a semiconductor light source (an explanatory view corresponding to the sectional view taken along the line IV-IV in FIG. 3).

The auxiliary lens section 31, as shown in FIG. 4 and FIG. 5, is provided at the periphery of the main lens section 30, in the embodiment, at a lower edge (a lower side). As a result, as shown in FIG. 9, between the semiconductor light source 2 and an upper portion of the lens 3, an opening portion (an upper opening portion WU) is formed.

The auxiliary lens section 31 effectively utilizes another portion L2 of the peripheral light, of the light that is radiated from the semiconductor light source 2. Another portion L2 of the peripheral light is light which is made incident to the auxiliary lens section 31, of the peripheral light. The auxiliary lens section 31, in this example, is a lens section of full reflection type to reflect another portion L2 of the peripheral light. The auxiliary lens section 31 is integrated with the main lens section 30.

The auxiliary lens section 31 emits another portion L2 of the peripheral light toward the forward direction of the vehicle C, as an auxiliary light distribution pattern, in the embodiment, as an auxiliary light distribution pattern SLP of a low-beam light distribution pattern shown in FIG. 6 (B) and an auxiliary light distribution pattern SHP of a high-beam light distribution pattern shown in FIG. 7 (B). That is, the auxiliary lens section 31 emits the light having transmitted the light control member 4 from the semiconductor light source 2 (another portion L2 of the peripheral light), toward the forward direction of the vehicle C, as the auxiliary light distribution pattern SLP of the low-beam light distribution pattern, and emits the light that is directly made incident from the semiconductor light source 2 (another portion L2 of the peripheral light), toward the forward direction of the vehicle C, as the auxiliary light distribution pattern SHP of the high-beam light distribution pattern.

The auxiliary lens section 31 is composed of an incidence surface 310 to which another portion L2 of the peripheral light is made incident into the auxiliary lens section 31; a reflection surface 311 on which the light having been made incident from the incidence surface 310 into the auxiliary lens section 31 is reflected; and an emission surface 312 from which the reflected light having been reflected on the reflection surface 311 is emitted to the outside from the inside of the auxiliary lens 31. The incidence surface 310, the reflection surface 311, and the emission surface 312 are respectively made of free curved surfaces (or composite quadratic curved surfaces).

(Description of Light Control Member 4)

The light control member 4 is provided with: a variable focal lens section 40 at a central portion thereof and a mounting section 41 at each of the left and right side parts thereof. The variable focal point lens section 40 and the mounting section 41 each are composed of a light transmission member, and forms an integral structure. The mounting section 41 is positioned and mounted to the base member 8 via the bearing member 7. As a result, the light control member 4 is rotatably mounted, between a first location and a second location, to the base member 8 via the bearing member 7. A rotation center O1 of the light control member 4 is positioned at a rear side and at a lower side significantly than the center O of the light emission surface 23.

The light control member 4 is constructed to be switchable in movement (rotation) between the first location and the second location by way of the drive member 5. The first location, as shown in FIG. 4, is a location in which the variable focal point lens section 40 is positioned between the light emission surface 23 of the semiconductor light source 2 and the incidence surface 310 of the auxiliary lens section 31. The second location, as shown in FIG. 5, is a location in which the variable focal point lens section 49 is positioned between the light emission surface 23 of the semiconductor light source 2 and a central portion to which the center light L1 of the incidence surface 300 of the main lens section 30 is made incident.

Figure 10:
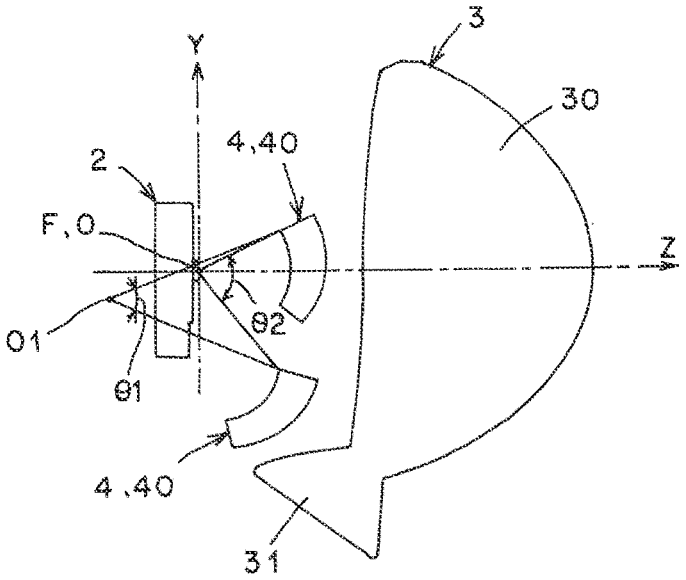
FIG. 10 is an explanatory view showing a rotation center between a first location and a second location of the light control member (an explanatory view corresponding to the sectional view taken along the line IV-IV in FIG. 3).

The variable focal point lens section 40 of the light control member 4 that is positioned in the first location and the auxiliary lens section 31 of the lens 3, as shown in FIG. 4, FIG. 9, and FIG. 10, partially (mostly) overlap each other on top and bottom. As a result, as shown in FIG. 9, between the semiconductor light source 2 and the lower portion of the lens 3 and the light control member 4, a slight opening portion (a lower opening portion WD) is formed.

(Description of Variable Focal Point Lens Section 40)

When the variable focal point lens section 40 is positioned in the first location, as shown in FIG. 4, another portion L2 of the peripheral light is transmitted and then is made incident into the auxiliary lens section 31. As a result, as shown in FIG. 6 (B), the auxiliary light distribution pattern SLP of the low-beam light distribution pattern is emitted toward the forward direction of the vehicle C from the emission surface 312 of the auxiliary lens section 31.

When the variable focal point lens section 40 is positioned in the second location, as shown in FIG. 5, the center light L1 is transmitted and then is made incident into the central portion of the main lens section 30. As a result, as shown in FIG. 7 (A), the main light distribution pattern MHP of the high-beam light distribution pattern is emitted toward the forward direction of the vehicle C from the central portion of the emission surface 301 of the main lens section 30.

In so far as the variable focal point lens section 40 is concerned, as shown in FIG. 1, FIG. 4, and FIG. 5, an incidence surface 400 forms a concave shape and an emission surface 401 forms a convex shape. The incidence surface 400 of the variable focal point lens section 40 forms the concave shape in an optical axis (a light emission axis) direction of the variable focal point lens section 40, that is, inside of the variable focal point lens section 40 with respect to the light emitting surface 23 of the semiconductor light source 2. The emission surface 401 of the variable focal point lens section 40 forms a convex shape in the optical axis (the light emission axis) direction of the variable focal point lens section 49, that is outside of the variable focal point lens section 40 with respect to the light emitting surface 23 of the semiconductor light source 2.

Figure 11:
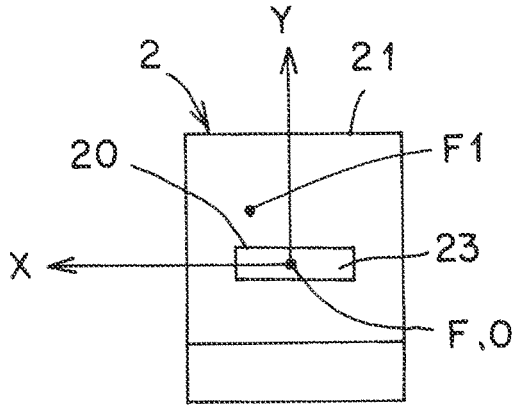
FIG. 11 is a sectional view showing an outline of the semiconductor light source.

The variable focal lens section 40 varies a focal point of the auxiliary lens section 31. That is, as shown in FIG. 11, a focal point (a pseudo focal point) F1 of the auxiliary lens section 31 when positioned in the first location is displaced to the upper side and the right side with respect to the focal point F of the auxiliary lens section 31 when positioned in the second location. It is to be noted that, although the displacement to the upper side of the pseudo focal point F1 is shown in FIG. 9 (FIG. 13), the displacement to the right side is not shown. The pseudo focal point F1 is a pseudo focal point of the auxiliary lens section 31 through the variable focal point lens section 40.

In so far as the variable focal point lens section 40 is concerned, in a horizontal cross section, a distance between the incidence surface 400 and the emission surface 401 is gradually reduced on the opposite lane side, in this example, from the right side to the cruising lane side, in this example, to the left side. That is, a distance between the incidence surface 400 and the emission surface 401 at a right end part of the variable focal point lens section 40 is long, and a distance between the incidence surface 400 and the emission surface 401 at a left end part of the variable focal point lens section 40 is short.

In so far as the variable focal point lens section 40 is concerned, in a vertical cross section, a distance between the incidence surface 400 and the emission surface 401 is gradually reduced from the upper side to the lower side. That is, a distance between the incidence surface 400 and the emission surface 401 at an upper end part of the variable focal point lens section 40 is long, and a distance between the incidence surface 400 and the emission surface 401 at a lower end part of the variable focal point lens section 40 is short. It is to be noted that, in the vertical cross section, there may be a case in which the distance between the incidence surface 400 and the emission surface 401 at the upper side, and the distance between the incidence surface 400 and the emission surface 401 at the lower side are not varied.

The variable focal point lens section 40, by the structure mentioned previously, displaces the focal point (the pseudo focal point) F1 of the auxiliary lens section 31 when positioned in the first location to the upper side and the right side with respect to the focal point F of the auxiliary lens section 31 when positioned in the second location. That is, the variable focal point lens section 40 varies the position of the light emitting chip 20 (the light emission surface 23) of the semiconductor light source 2 from an actual location to a virtual right oblique lower position.

In this manner, the auxiliary light distribution pattern SLP of the low-beam light distribution pattern shown in FIG. 6 (B) varies its orientation to the right obliquely lower side with respect to the auxiliary light distribution pattern SHP of the high-beam light distribution pattern shown in FIG. 7 (B). As a result, as shown in FIG. 6 (B), the auxiliary light distribution pattern SLP of the low-beam light distribution pattern is positioned at the lower side more significantly than the lower horizontal cutoff line CL1 of the low-beam light distribution pattern LP.

In addition, the variable focal point lens section 40 varies the focal point of the main lens section 30 and then switches the main light distribution pattern that is emitted from the main lens section 30. That is, when the variable focal lens section 40 is positioned in the first location, as shown in FIG. 4, the center light L1 and a part of the peripheral light are directly made incident into the main lens section 30. As a result, the main light distribution pattern MLP of the low-beam light distribution pattern (refer to FIG. 6 (A)) is emitted toward the forward direction of the vehicle C from the emission surface 301 of the main lens section 30.

When the variable focal point lens section 40 is positioned in the second location, as shown in FIG. 5, the center light L1 is transmitted and then is made incident to the central portion of the main lens section 30. As a result, the main light distribution pattern MHP of the high-beam light distribution pattern (refer to FIG. 7 (A)) is emitted toward the forward direction of the vehicle C from the central portion of the emission surface 301 of the main lens section 30.

At this time, the variable focal point lens section 40 gradually rises a part of the light at the central portion of the main light distribution pattern MLP of the low-beam light distribution pattern upward in a reversed V-shape from the cutoff lines CL1, CL2, CL3 at the central portion of the main light distribution pattern MLP of the low-beam light distribution pattern. As a result, the central portion of the main light distribution pattern MLP of the low-beam light distribution pattern shown in FIG. 6 (A) is deformed to the central portion of the main light distribution pattern MHP of the high-beam light distribution pattern shown in FIG. 7 (A). Due to the deformation of the central portion of the main light distribution pattern, the feeling of moderation in switching the light distribution pattern is obtained.

(Description of Drive Member 5)

The drive member 5, as shown in FIG. 1 and FIG. 2, positions the light control member 4 to be switchable in movement (rotation or turning) between the first location and the second location. The drive member 5 is composed of a solenoid 50, a connecting pin 51, and a spring 52.

At the solenoid 50, a mounting section 53 is integrally provided. The mounting section 53 is positioned at a rear side of a base mounting section 82 of the base member 8 by way of a positioning hole and a positioning pin and is mounted to the rear side of the base mounting section 82 of the casing member 8 by way of a screw or the like. As a result, the solenoid 50 of the drive member 5 is mounted to the base member 8. The solenoid 50 has a reciprocating rod 54.

One end of the connecting pin 51 is fixed to a tip end of the reciprocating rod 54. The other end of the connecting pin 51 is inserted into an elongated hole 42 which is provided in the mounting section 41 of the light control member 4. As a result, a reciprocating motion of the reciprocating rod 54 of the solenoid 50 is converted to a rotational motion of the light control member 4 via the connecting pin 51 and the elongated hole 42.

The spring 52 is mounted to the bearing member 7. One end of the spring 52 elastically abuts against the bearing member 7. The other end of the spring 52 elastically abuts against the light control member 4. As a result, at the time of a normal mode, that is, when the solenoid 50 is not powered on, the light control member 4 is positioned in the first location due to a force of the spring 52. When power is supplied to the solenoid 50, the reciprocating rod 54 that is positioned in a forward location retracts against the force of the spring 52, and the light control member 4 rotates from the first location to the second location and then is positioned in the second location. If power supply to the solenoid 50 is shut off, the reciprocating rod 54 that is positioned in a backward location is advanced due to the force of the spring 52, and the light control member 4 rotates from the second location to the first location and then is positioned in the first location.

(Description of Lens Covering Member 6)

The lens covering member 6, as shown in FIG. 1 to FIG. 3, forms a shape to covering the lens 3. The lens covering member 6, for example, is composed of a light non-transmission member. At a central portion of the lens covering member 6, there is provided an opening portion 60 to direct the light from the semiconductor light source 2 to the main lens section 30 and the auxiliary lens section 31 of the lens 3. At each of the left and right end parts of the lens covering member 6, a mounting section 61 is integrally provided. The mounting section 61, together with the mounting section 32 of the lens 3, is positioned at the lens mounting section 81 of the base member 8 by way of a positioning hole and a positioning pin or the like, and is mounted to the lens mounting section 81 of the base member 8 by way of a screw or the like. As a result, the lens covering member 6 is mounted to the base member 8 together with the lens 3.

(Description of Bearing Member 7)

The bearing member 7, as shown in FIG. 1 and FIG. 2, forms a shape to cover the semiconductor light source 2 and the light source mounting section 80 of the base member 8. The bearing member 7 is composed of a light non-transmission member, for example. At a central portion of the bearing member 7, there is provided an opening portion 70 to route the light from the semiconductor light source 2 to the main lens section 30 and the auxiliary lens section 31 of the lens 3 and the variable focal point lens section 40 of the light control member 4. At each of the four corners of the bearing member 7, a mounting section 71 is integrally provided. The mounting section 71 is positioned at a front side of the base mounting section 82 of the base member 8 by way of a positioning hole and a positioning pin or the like, and is mounted to the front side of the base mounting section 82 of the base member 8 by way of a screw or the like. As a result, the bearing member 7 is mounted to the base member 8.

At central portions of both the left and right sides of the bearing member 7, shaft parts 72 are respectively integrally provided. At the shaft parts 72, rotation holes 73 which are provided in the mounting section 41 of the light control member 4 are rotatably borne. As a result, to the bearing member 7, the light control member 4 is mounted to be rotatable between the first location and the second location.

At the bearing member 7 and the light control member 4, stoppers 73, 44 are respectively integrally provided. In this manner, the light control member 4 can be positioned in the first location and the second location.

(Description of Base Member 8)

The base member 8, as shown in FIG. 1 to FIG. 3, is composed of: the base mounting section 82; the light source mounting section 80 at the central portion of the front side of the base mounting section 82; and the lens mounting section 81 at each of the left and right end parts of the front side of the base mounting section 82. The semiconductor light source 2 is mounted to the light source mounting section 80. To the lens mounting section 81, the lens 3 is mounted via the lens covering member 6. At the front side of the base mounting section 82, the bearing member 7 on which the light control member 4 is rotatably borne between the first location and the second location is mounted. At the rear side of the base mounting section 82, the drive member 5 and the cooling member 9 are respectively mounted in their appropriate locations.

(Description of Cooling Member 9)

The cooling member 9, as shown in FIG. 1 and FIG. 2, has a cooling fan. The cooling member 9 is positioned at the rear side of the base mounting section 82 of the base member 8, and is mounted to the rear side of the base mounting section 82 of the casing member 8 by way of a screw or the like. As a result, the cooling member 9 is mounted to the base member 8.

(Description of Functions of First Embodiment)

The vehicle headlamp 1 according to the first embodiment is made of the constituent elements as described above, and hereinafter, functions thereof will be described.

At the time of the normal mode, that is, when the solenoid 50 is not powered on, due to the spring force of the spring 52, the reciprocating rod 54 is position in the forward location, and the light control member 4 is positioned in the first location. At this time, the variable focal point lens section 40 of the light control member 4, as shown in FIG. 4, is positioned between the light emission surface 23 of the semiconductor light source 2 and the incidence surface 310 of the auxiliary lens section 31 of the lens 3.

At the time of the normal mode, the light emitting chip 20 of the semiconductor light source 2 is lit. Subsequently, of the light that radiated from the light emission surface 23 of the light emitting chip 20, the center light L1 and a part of the peripheral light from the semiconductor light source 2, as shown in FIG. 4, is directly made incident into the main lens section 30 from the incidence surface 300 of the main lens section 30 of the lens 3. At this time, the incident light is controlled to be optically distributed in the incidence surface 300. The incident light having been made incident into the main lens section 30 is emitted from the emission surface 301 of the main lens section 30. At this time, the thus emitted light is controlled to be optically distributed in the emission surface 301. The emitted light from the main lens section 30, as shown in FIG. 6 (A), is emitted toward the forward direction of the vehicle C, as the main light distribution pattern MLP of the low-beam light distribution pattern having the lower horizontal cutoff line CL1, the oblique cutoff line CL2, the upper horizontal cutoff line CL3.

On the other hand, of the light that is radiated from the light emission surface 23 of the light emitting chip 20, another portion L2 of the peripheral light from the semiconductor light source 2, as shown in FIG. 4, is made incident into the variable focal point lens section 40 from the incidence surface 400 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the emitted light is controlled to be optically distributed in the emission surface 401.

The emitted light from the variable focal point lens section 40 is made incident into the auxiliary lens section 31 from the emission surface 310 of the auxiliary lens section 31. At this time, the incident light is controlled to be optically distributed in the incidence surface 310. The incident light having been made incident to the auxiliary lens section 31 is fully reflected on the reflection surface 311 of the auxiliary lens 31. At this time, the thus reflected light is controlled to be optically distributed in the reflection surface 311. The fully reflected light is emitted from the emission surface 312. At this time, the thus emitted light is controlled to be optically distributed in the emission surface 312. The emitted light from the auxiliary lens section 31, as shown in FIG. 6 (B), as the auxiliary light distribution patter SLP of the low-beam light distribution pattern, is emitted toward the forward direction of the vehicle C and right oblique downward with respect to the central portion of the main light distribution pattern MLP of the low-beam light distribution pattern that is emitted from the main lens section 30.

Here, due to action of displacement of the focal point of the variable focal point lens section 40, the focal point F of the auxiliary lens section 31, as shown in FIG. 11, is displaced to a right oblique upward pseudo focal point F1. Thus, the position of the light emitting chip 20 (the light emission surface 23) of the semiconductor light source 2 varies from the actual location to the right oblique downward pseudo location. In this manner, the auxiliary light distribution pattern SLP of the low-beam light distribution pattern is positioned right oblique downward with respect to a center of the screen (a cross point between the horizontal line HL-HR from the left to the right of the screen and the vertical line VU-VD from the top to the bottom of the screen). That is, the auxiliary light distribution patter SLP of the low-beam light distribution pattern, as shown in FIG. 6 (B), is positioned more downward than the lower horizontal cutoff line CL1 of the main light distribution pattern MLP of the low-beam light distribution pattern.

Then, the main light distribution pattern MLP of the low-beam light distribution pattern (refer to FIG. 6 (A)) having the lower horizontal cutoff line CL1, the oblique cutoff line CL2, and the upper horizontal cutoff line CL3; and the auxiliary light distribution pattern SLP (refer to FIG. 6 (B)) of the low-beam light distribution pattern are combined (weighted) with each other, and the light distribution pattern LP (refer to FIG. 6 (C) and FIG. 8 (A)) having the lower horizontal cutoff line CL1, the oblique cutoff line CL2, and the upper cutoff line CL3 is obtained.

Then, power is supplied to the solenoid 50. Afterwards, the reciprocating rod 54 retracts against the spring force of the spring 52 and then is positioned in the backward location, and the light control member 4 rotates from the first location to the second location and then is positioned in the second location. That is, the light control member 4 having been positioned between the semiconductor light source 2 and the auxiliary lens section 31 up to now, as shown in FIG. 5, is positioned between the light emission surface 23 of the semiconductor light source 2 and the incidence surface 300 of the main lens section 30 of the lens 3.

Subsequently, of the light that is radiated from the light emission surface 23 of the light emitting chip 20, the center light L1 of the semiconductor light source 2 is made incident into the variable focal point lens section 40 from the incidence surface 400 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the thus emitted light is controlled to be optically distributed in the emission surface 401.

The emitted light from the variable focal point lens section 40 is made incident into the main lens section 30 from the emission surface 300 of the main lens section 30. In addition, a part of the peripheral light from the semiconductor light source 2 is directly made incident into the main lens section 30 from the incidence surface 300 of the main lens section 30. At this time, the incident light is controlled to be optically distributed in the incidence surface 300. The incident light having been made incident into the main lens section 30 is emitted from the emission surface 301 of the main lens section 30. At this time, the thus emitted light is controlled to be optically distributed in the emission surface 301. The emitted light from the main lens section 30, as shown in FIG. 7 (A), is emitted toward the forward direction of the vehicle C, as the main light distribution pattern MHP of the high-beam light distribution pattern.

Here, the main light distribution pattern MHP of the high-beam light distribution pattern is emitted from the main lens section 30 via the variable focal point lens section 40. Thus, the central portion of the main light distribution pattern MHP of the high-beam light distribution pattern, shown in FIG. 7 (A), is deformed in a state in which a part of the central portion of the main light distribution pattern MLP of the low-beam light distribution pattern shown in FIG. 6 (A) rises upward in a reverse V-shape. At this time, a sense of moderation in switching the light distribution pattern is obtained.

On the other hand, of the light that is radiated from the light emission surface 23 of the light emitting chip 20, another portion L2 of the peripheral light from the semiconductor light source 2, as shown in FIG. 5, is made incident into the auxiliary lens section 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the thus reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31, as shown in FIG. 7 (B), as the auxiliary light distribution pattern SHP of the high-beam light distribution pattern, is emitted toward the forward direction of the vehicle C and toward the central portion of the main light distribution pattern MHP of the high-beam light distribution pattern that is emitted from the main lens section 30.

Here, the auxiliary light distribution pattern SHP of the high-beam light distribution pattern is directly emitted from the auxiliary lens section 31 without interposing the variable focal point lens section 40. Thus, the focal point F of the auxiliary lens section 31 is positioned in its essential location, that is, at or near the center O of the light emission surface 23 of the light emitting chip 20 of the semiconductor light source 2. In this manner, the auxiliary light distribution pattern SHP of the high-beam light distribution pattern is positioned at or near the center of the screen (the cross point between the horizontal line HL-HR from the left to the right of the screen and the vertical line VU from the top to the bottom of the screen). That is, the auxiliary light distribution pattern SHP of the high-beam light distribution pattern is positioned at the central portion of the main light distribution pattern MHP of the high-beam light distribution pattern.

Then, the main light distribution pattern MHP of the high-beam light distribution pattern (refer to FIG. 7 (A)) and the auxiliary light distribution pattern SHP of the high-beam light distribution pattern (refer to FIG. 7 (B)) are combined (weighted) with each other, and the light distribution pattern HP having a hot zone HZ at a central portion thereof (refer to FIG. 7 (C) and FIG. 8 (B)) is obtained.

Then, power supply to the solenoid 50 is shut off. Afterwards, the reciprocating rod 54 is advanced and then is positioned in the forward location due to the spring force of the spring 52 and then the light control member 4 rotates from the second location toward the first location and is positioned in the first location. That is, the light control member 4 having been positioned between the semiconductor light source 2 and the main lens section up to now is positioned between the semiconductor light source 2 and the auxiliary lens section 31.

(Description of Advantageous Effect of First Embodiment)

The vehicle headlamp 1 according to the first embodiment is made of the constituent elements and functions as described above, and hereinafter, advantageous effect thereof will be described.

In so far as the vehicle headlamp 1 according to the first embodiment is concerned, when the light control member 4 is positioned in the first location, a part of the light from the semiconductor light source 2 (the center light L1 and a part of the peripheral light) is directly made incident to the main lens section 30 of the lens 3, and the residue of the light from the semiconductor light source 2 (another portion L2 of the peripheral light) is made incident to the auxiliary lens section 31 of the lens 3 via the light control member 4 and then from the lens 3, the low-beam light distribution pattern LP is emitted toward the forward direction of the vehicle C. In addition, when the light control member 4 is positioned in the second location, a part of the light from the semiconductor light source 2 (the center light L1) is made incident to the main lens section 30 of the lens 3 via the light control member 4, and a part of the light from the semiconductor light source 2 (a part of the peripheral light) is directly made incident to the main lens section 30 of the lens 3 and the residue of the light from the semiconductor light source 2 (another portion L2 of the peripheral light) is directly made incident to the auxiliary lens section 31 of the lens 3 and then from the lens 3, the high-beam light distribution pattern HP is emitted toward the forward direction of the vehicle C, and as a result, in the direct illumination lens-type lamp unit, the low-beam light distribution pattern LP and the high-beam light distribution pattern HP are reliably obtained.

In so far as the vehicle headlamp 1 according to the first embodiment is concerned, when the light control member 4 is positioned in the first location, a part of the light from the semiconductor light source 2 (the center light L1 and a part of the peripheral light) is directly made incident to the main lens section 30 and the residue of the light from the semiconductor light source 2 (another portion L2 of the peripheral light) is made incident to the auxiliary lens 31 via the light control member 4 and thus the light from the semiconductor light source 2 (the center light L1 and a part of the peripheral light or another portion L2 of the peripheral light) can be effectively utilized. In addition, when the light control member 4 is positioned in the second location, a part of the light from the semiconductor light source 2 (the center light L1) is made incident to the main lens section 30 via the light control member 4 and a part of the light from the semiconductor light source 2 (a part of the peripheral light) is directly made incident to the main lens section 30 and then the residue of the light from the semiconductor light source 2 (another portion L2 of the peripheral light) is directly made incident to the auxiliary lens section 31 and thus the light from the semiconductor light source 2 (the center light L1 and a part of the peripheral light or another portion L2 of the peripheral light) can be effectively utilized.

The vehicle headlamp 1 according to the first embodiment moves and switches the light control member 4 that is one component between the first location and the second location by way of the drive member 5. Thus, the positional precision of the first location and the second location of the light control member 4 can be enhanced. Moreover, it is sufficient if the drive member 5 is the solenoid 50 with its low output and the spring 52 with its small spring load and thus manufacturing costs can be reduced.

The vehicle headlamp 1 according to the first embodiment is provided with the variable focal point lens section 40 that displaces the focal point F1 of the auxiliary lens section 31 when the light control member 4 is positioned in the first location, to the upper side with respect to the focal point F of the auxiliary lens section 31 when the light control member is positioned in the second location. Thus, the auxiliary light distribution pattern SLP of the low-beam light distribution pattern, that is obtained when the light control member 4 is positioned in the first location, can be positioned downward with respect to the center of the screen. That is, the auxiliary light distribution pattern SLP of the low-beam light distribution pattern, as shown in FIG. 6 (B), can be positioned more downward than the lower horizontal cutoff line CL1 of the main light distribution pattern MLP of the low-beam light distribution pattern, and an occurrence of glare can be reliably prevented.

In so far as the vehicle headlamp 1 according to the first embodiment is concerned, the light control member 4 rotates between the first location and the second location by way of the drive member 5, and a rotation center O1 of the light control member 4 is positioned at the rear side more significantly than the light emission surface 23 of the semiconductor light source 2. Thus, as shown in FIG. 10, a rotation angle θ1 of the light control member 4 can be reduced in comparison with a rotation angle θ2 in a case where the center O of the light emission surface 23 is defined as a rotation center of the light control member 4. In this manner, the drive member 5 can be downsized and low in output and thus downsizing and cost reduction of the unit can be achieved.

In so far as the vehicle headlamp 1 according to the first embodiment is concerned, the auxiliary lens 31 is disposed at a lower side with respect to the main lens section 30. Thus, when the drive member 5 is not driven, if the light control member 4 is positioned in the first location, the light control member 4 can be stopped at the lower side, that is, in a gravitational direction. In this manner, it is sufficient if the drive member 5 is inexpensive and low in output, for example, is the solenoid 50 with its low output and the spring 52 with its small spring load and thus manufacturing costs can be reduced.

In so far as the vehicle headlamp 1 according to the first embodiment is concerned, the light control member 4 and the auxiliary lens section 31 that are positioned in the first location partially overlap each other on top and bottom. Thus, as shown in FIG. 9, if the light control member 4 and the auxiliary lens section 31 are positioned at the lower side, a large upper opening portion WU is obtained at the upper portion, and a slight lower opening portion WD is formed at the lower portion. In this manner, as indicated by the solid arrow A in FIG. 9, a heat convection from the lower opening portion WD to the upper opening portion WU is generated. As a result, a heat which is generated in the semiconductor light source 2 (an LED radiant heat), as indicated by the solid arrow in FIG. 9, can be released from the upper opening portion WU to the outside along the heat convection, and a heat radiation effect can be enhanced.

Second Embodiment

Figure 12:
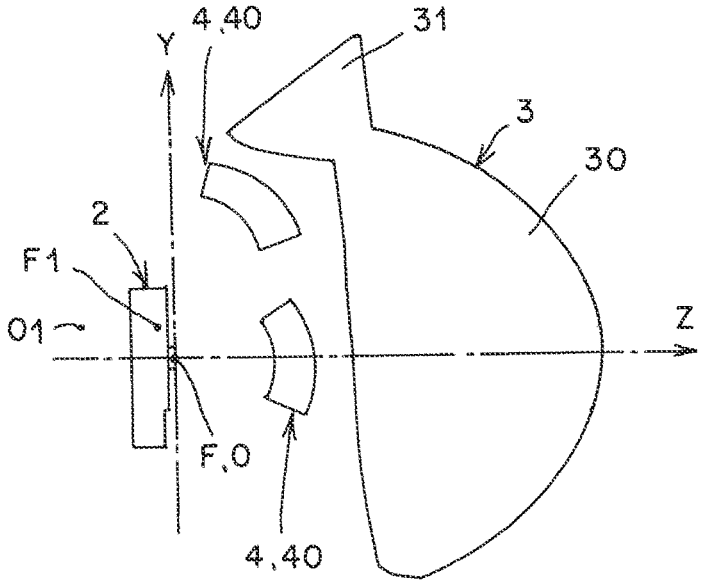
FIG. 12 is an explanatory view showing a second embodiment of a vehicle headlamp according to the present invention (an explanatory view corresponding to the sectional view taken along the line IV-IV in FIG. 3).

FIG. 12 shows a second embodiment of a vehicle headlamp according to the present invention. Hereinafter, the vehicle headlamp according to the second embodiment will be described. In the figure, the same reference numerals in FIG. 1 to FIG. 11 designate the same constituent elements.

The vehicle headlamp 1 according to the first embodiment positions the auxiliary lens section 31 at the lower side with respect to the main lens section 30 and positions the first location of the light control member 4 at the lower side. On the other hand, the vehicle headlamp according to the second embodiment positions the auxiliary lens 31 at an upper side with respect to the main lens section 30 and positions the first location of the light control member 4 at the upper side, and further positions the rotation center O1 of the light control member 4 at the rear side and at the upper side more significantly than the center O of the light emission surface 23.

The vehicle headlamp according to the second embodiment is made of the constituent elements and functions as described above and thus advantageous effect substantially similar to that of the vehicle headlamp 1 of the first embodiment can be achieved.

Third Embodiment

FIG. 13 to FIG. 16 each show a third embodiment of a vehicle headlamp according to the present invention. Hereinafter, the vehicle headlamp according to the third embodiment will be described. In the figures, the same reference numerals in FIG. 1 to FIG. 12 designate the same constituent elements.

The conventional headlamp is provided with a light source, a lens, a first reflection surface, and a second reflection surface. In addition, in so far as the conventional vehicle headlamp is concerned, when the first reflection surface is positioned in an open location, light from the light source transmits the lens and then the light is emitted toward a forward direction of a vehicle, as a light distribution pattern for passing beam. Further, when the first reflection surface is positioned in a light shading location, the light from the light source is reflected on the first reflection surface, and the thus reflected light is reflected on the second reflection surface and then is emitted toward the forward direction of the vehicle, as a light distribution pattern for cruising beam.

In such conventional vehicle headlamp, due to a dimensional tolerance and a mounting distortion of components, when the light distribution pattern for passing beam is emitted toward the forward direction of the vehicle, there may be a case in which stray light is generated. However, in the conventional vehicle headlamp, means for preventing the generation of the stray light is not provided.

A problem to be solved by the present invention is that, in the conventional vehicle headlamp, the means for preventing the generation of the stray light is not provided.

Figure 13:
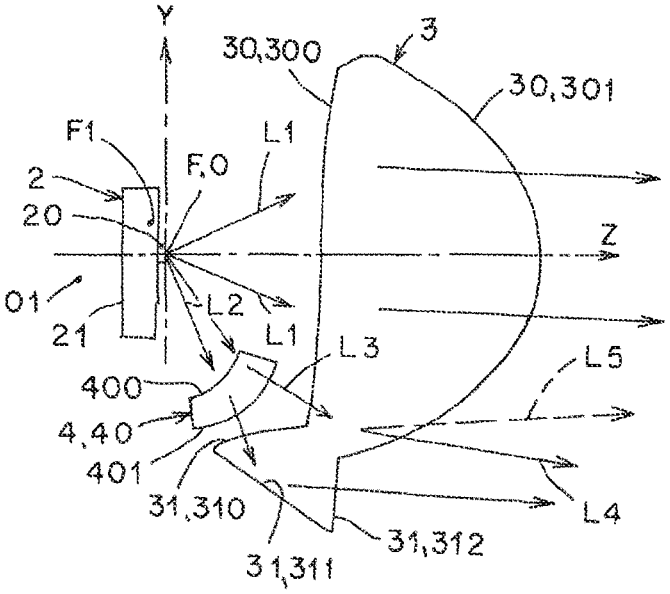
FIG. 13 is an explanatory view showing an optical path when a light control member is positioned in a first location in a third embodiment of a vehicle headlamp (an explanatory view corresponding to the sectional view taken along the line IV-IV in FIG. 3).

The present invention, as shown in FIG. 13, is provided with a semiconductor light source 2, a lens 3, a light control member 4, and a drive member 5. The lens 3 is composed of a main lens section 30 and an auxiliary lens section 31. The drive member 5 positions the light control member 4 to be switchable between a first location and a second location. Of the light control member 4, a focal point F40U of an upper portion 40U which is on the optical axis Z side of the main lens section 30 when positioned in the first location is displaced to a lower side with respect to a focal point F40D of a lower portion 40D.

Figure 15:
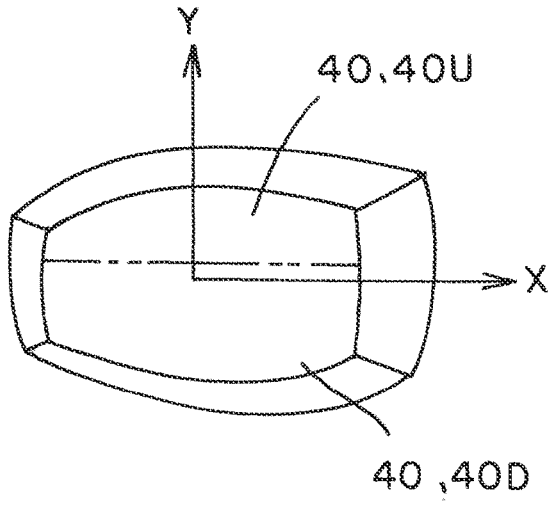
FIG. 15 is a rear view showing a variable focal point lens section of the light control member.

When the light control member 4 is positioned in the first location, the part 40U that is positioned on the main lens section 30 side, of the variable focal point lens section 40 of the light control member 4, is an upper portion more significantly than the double-dotted chain line shown in FIG. 15. In addition, when the light control member 4 is positioned in the first location, a part 40D opposite to the part 40U that is positioned on the main lens section 30 side, of the variable focal point lens section 40 of the light control member 4, is a lower portion more significantly than the double-dotted chain line shown in FIG. 15.

Figure 16:
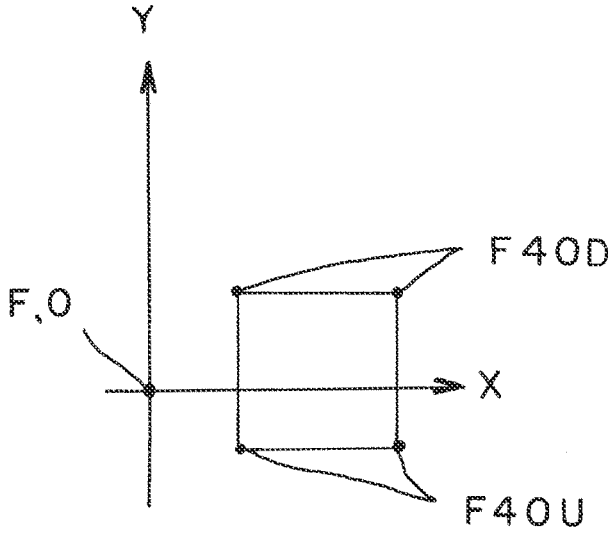
FIG. 16 is an explanatory view showing a position of a focal point of the variable focal point lens section of the light control member.

The upper portion 40U of the variable focal point lens section 40 continuously displaces the reference focal point F of the main lens section 30 to a lower side (refer to F40U in FIG. 16). The lower portion 40D of the variable focal point lens section 40 continuously displaces the reference focal point F of the main lens section 30 to an upper side (refer to FIG. 40D in FIG. 16). That is, the focal point F40U of the upper portion 40U of the variable focal point lens section 40 is displaced to a lower side with respect to the focal point F40D of another portion (the lower portion 40D).

(Description of Functions of Third Embodiment)

The vehicle headlamp 1 according the third embodiment is made of the constituent elements as described above, and hereinafter, functions thereof will be described.

At the time of a normal mode, that is, when the solenoid 50 is not powered on, due to the spring force of the spring 52, the reciprocating rod 54 is positioned in the forward location, and the light control member 4 is positioned in the first location. At this time, the variable focal point lens section 40 of the light control member 4, as shown in FIG. 13, is positioned between the light emission surface 23 of the semiconductor light source 2 and the incidence surface 310 of the auxiliary lens section 31 of the lens 3.

At the time of the normal mode, the light emitting chip 30 of the semiconductor light source 2 is lit. Afterwards, of the light that is radiated from the light emission surface 23 of the light emitting chip 20, the center light L1 and a part of the peripheral light from the semiconductor light source 2, as shown in FIG. 13, are directly made incident into the main lens section 30 from the incidence surface 300 of the main lens section 30 of the lens 3. At this time, the incident light is controlled to be optically distributed in the incidence surface 300. The incident light having been made incident into the main lens section 30 is emitted from the emission surface 301 of the main lens section 30. At this time, the thus emitted light is controlled to be optically distributed in the emission surface 301. The emitted light from the main lens section 30 is emitted toward the forward direction of the vehicle C, as the main light distribution pattern of the low-beam light distribution pattern LP having the lower horizontal cutoff line, the oblique cutoff line, and the upper horizontal cutoff line.

On the other hand, of the light that is radiated from the light emission surface 23 of the light emitting chip 20, another part L2 of the peripheral light from the semiconductor light source 2, as shown in FIG. 13, is made incident into the variable focal point lens section 40 from the incidence surface 400 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the thus emitted light is controlled to be optically distributed in the emission surface 401.

The emitted light from the variable focal point lens section 40 is made incident into the auxiliary lens section 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the thus reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31 is emitted toward the forward direction of the vehicle C, as the auxiliary light distribution pattern of the low-beam light distribution pattern LP.

Then, the main light distribution pattern and the auxiliary light distribution pattern are combined (weighted) with each other, and the low-beam light distribution pattern LP shown in FIG. 8 (A) is obtained.

At this time, the focal point F40U of the upper portion 40U that is at the reference optical axis Z side of the main lens section 30, of the variable focal point lens section 40, is displaced to the lower side with respect to the focal point D40D of the lower portion 40D. Thus, as shown in FIG. 13, the emitted light L3 having been emitted from the upper portion 40U of the variable focal point lens section 40 is obtained as downward emitted light. Therefore, even if the emitted light L3 having been emitted from the upper portion 40U of the variable focal point lens section 40 is made incident to the main lens section 30 in place of the auxiliary lens section 31, the emitted light L4 having been emitted from the main lens section 30 is oriented downward. This downward emitted light L4 is obtained as a part of the low-beam light distribution pattern LP.

Afterwards, power is supplied to the solenoid 50. Then, the reciprocating rod 54 is retracted against the spring force of the spring 52, and is positioned in a backward location, and the light control member 4 rotates from the first location to the second location and then is positioned in the second location. That is, the light control member 4 having been positioned between the semiconductor light source 2 and the auxiliary lens 31 up to now, as shown in FIG. 14, is positioned between the light emission surface 23 of the semiconductor light source 2 and the incidence surface 300 of the main lens section 30 of the lens 3.

Subsequently, of the light that is radiated from the light emission surface 23 of the light emitting chip 20, the center light L1 of the semiconductor light source 2 is made incident into the variable focal point lens section 40 from the incidence surface 400 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the thus emitted light is controlled to be optically distributed in the emission surface 401.

The emitted light from the variable focal point lens section 40 is made incident into the main lens section 30 from the incidence surface 300 of the main lens section 30. In addition, a part of the peripheral light from the semiconductor light source 2 is directly made incident into the main lens section 30 from the incidence surface 300 of the main lens section 30. At this time, the incident light is controlled to be optically distributed in the emission surface 300. The incident light having been made incident into the main lens section 30 is emitted from the emission surface 301 of the main lens section 30. At this time, the thus emitted light is controlled to be optically distributed in the emission surface 300. The emitted light from the main lens section 30 is emitted toward the forward direction of the vehicle C, as the main light distribution pattern of the high-beam light distribution pattern HP.

Figure 14:
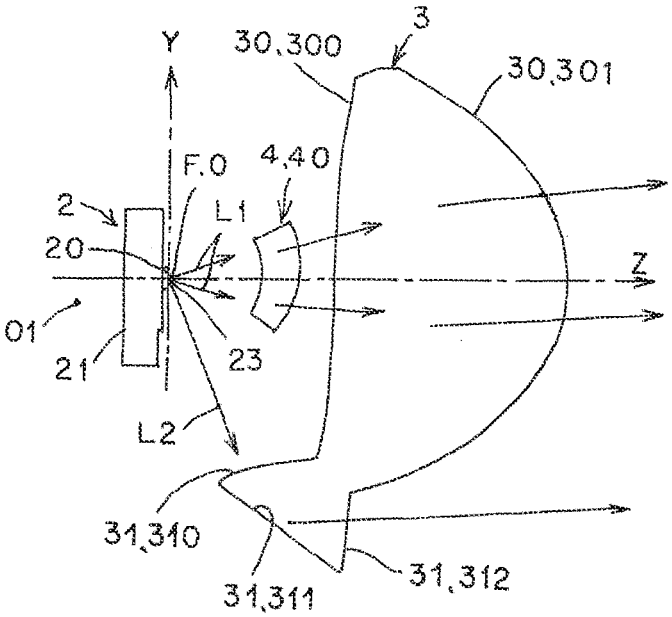
FIG. 14 is an explanatory view showing an optical path when a light control member is positioned in a second location (an explanatory view corresponding to the sectional view taken along the line IV-IV in FIG. 3).

On the other hand, of the light that is radiated from the light emission surface 23 of the light emitting chip 20, another part L2 of the peripheral light from the semiconductor light source 2, as shown in FIG. 14, is made incident into the auxiliary lens section 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the thus reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31 is emitted toward the forward direction of the vehicle C, as the auxiliary light distribution pattern of the high-beam light distribution pattern HP.

Then, the main light distribution pattern and the auxiliary light distribution pattern are combined (weighted) with each other, and the high-beam light distribution pattern HP shown in FIG. 8 (B) is obtained.

Afterwards, power supply to the solenoid 50 is shut off. Then, the reciprocating rod 54 is advanced and is positioned in the forward location due to the spring force of the spring 52, and the light control member 4 rotates from the second location to the first location and is positioned in the first location. That is, the light control member 4 having been positioned between the semiconductor light source 2 and the main lens section 30 up to now is positioned between the semiconductor light source 2 and the auxiliary lens section 31.

(Description of Advantageous Effect of Third Embodiment)

The vehicle headlamp 1 according to the third embodiment is made of the constituent elements and functions as described above, and hereinafter, advantageous effect thereof will be described.

In so far as the vehicle headlamp 1 according to the third embodiment is concerned, the focal point F40U of the upper portion 40U that is at the reference optical axis Z side of the main lens section 30, of the variable focal point lens section 40 of the light control member 4, is displaced to the lower side with respect to the focal point F40D of the lower portion 40D that is another portion. Thus, as shown in FIG. 13, the emitted light L3 having been emitted from the upper portion 40U of the variable focal point lens section 40 is obtained as downward emitted light. Thus, even if the emitted light L3 having been emitted from the upper portion 40U of the variable focal point lens section 40 is made incident to the main lens section 30 in place of the auxiliary lens section 31, the emitted light L4 having been emitted from the main lens section 30 is oriented downward. This downward emitted light L4 is obtained as a part of the low-beam light distribution pattern LP. As a result, the generation of stray light can be prevented.

Here, a case in which a focal point of the upper portion 40U of the variable focal point lens section 40 is not displaced at all or is displaced to the upper side, with respect to a focal point of the lower portion 40D, will be described. In this case, the emitted light having been emitted from the upper portion 40U of the variable focal point lens section 40 is not obtained as downward emitted light. Thus, if the emitted light having been emitted from the upper portion 40U of the variable focal point lens section 40 is made incident to the main lens section 30, there may be a case in which the emitted light L5 having been emitted from the main lens section 30 is oriented upward (refer to the dashed arrow in FIG. 13). As a result, the generation of stray light cannot be prevented. On the other hand, the vehicle headlamp 1 according to the third embodiment is capable of preventing the generation of stray light as described previously.

In so far as the vehicle headlamp 1 according to the third embodiment is concerned, when the light control member 4 is positioned in the first location, a part of the light from the semiconductor light source 2 (the center light L1 and a part of the peripheral light) is directly made incident to the main lens section 30 of the lens 3, and the residue of the light from the semiconductor light source 2 (another part L2 of the peripheral light) is made incident to the auxiliary lens section 31 of the lens 3 via the light control member 4 and then from the lens 3, the low-beam light distribution pattern LP is emitted toward the forward direction of the vehicle C. In addition, when the light control member 4 is positioned in the second location, a part of the light from the semiconductor light source 2 (the center light L1) is directly made incident to the main lens section 30 of the lens 3 via the light control member 4 and a part of the light from the semiconductor light source 2 (a part of the peripheral light) is directly made to the main lens section 30 of the lens 3, and the residue of the light from the semiconductor light source 2 (another part L2 of the peripheral light) is directly made incident to the auxiliary lens section 31 of the lens 3 and then from the lens 3, the high-beam light distribution pattern HP is emitted to the forward direction of the vehicle C, and as a result, in the direct illumination lens-type amp unit, the low-beam light distribution pattern LP and the high-beam light distribution pattern HP are reliably obtained.

In so far as the vehicle headlamp 1 according to the third embodiment is concerned, when the light control member 4 is positioned in the first location, a part of the light from the semiconductor light source 2 (the center light L1 and a part of the peripheral light) is directly made incident to the main lens section 30, and the residue of the light from the semiconductor light source 2 (another part L2 of the peripheral light) is made incident to the auxiliary lens 31 via the light control member 4 and thus the light from the semiconductor light source 2 (the center light L1 and a part of the peripheral light or another part L2 of the peripheral light) can be effectively utilized. In addition, when the light control member 4 is positioned in the second location, a part of the light from the semiconductor light source 2 (the center light L1) is made incident to the main lens section 30 via the light control member 4 and a part of the light from the semiconductor light source 2 (a part of the peripheral light) is directly made incident to the main lens section 30, and the residue of the light from the semiconductor light source 2 (another part L2 of the peripheral light) is directly made incident to the auxiliary lens section 31 and thus the light from the semiconductor light source 2 (the center light L1 and a part of the peripheral light or another part L2 of the peripheral light) can be effectively utilized.

The vehicle headlamp 1 according to the third embodiment moves and switches the light control member 4 that is one component between the first location and the second location by way of the drive member 5. Thus, the position precision of the first location and the second location of the light control member 4 can be enhanced. Moreover, it is sufficient if the drive member 5 is inexpensive and low in output, for example, is the solenoid 50 with its low output and the spring 52 with its small spring load and thus manufacturing costs can be reduced.

In so far as the vehicle headlamp 1 according to the third embodiment is concerned, the light control member 4 rotates between the first location and the second location by way of the drive member 5, and the rotation center O1 of the light control member 4 is positioned at the rear side more significantly than the light emission surface 23 of the semiconductor light source 2. Thus, as shown in FIG. 10, the rotation angle θ1 of the light control member 4 can be reduced in comparison with the rotation angle θ2 in a case where the center O of the light emission surface 23 is defined as the rotation center of the light control member 4. In this manner, the drive member 5 can be downsized and lowered in output and thus downsizing and cost reduction of the unit can be achieved.

In so far as the vehicle headlamp 1 according to the third embodiment is concerned, the auxiliary lens section 31 is disposed at the lower side with respect to the main lens section 30. Thus, when the drive member 5 is not driven, if the light control member 4 is positioned in the first location, the light control member 4 can be stopped at the lower side, that is, in the gravitational direction. In this manner, it is sufficient if the drive member 5 is inexpensive and low in output, for example, is the solenoid 50 with its low output and the spring 52 with its small spring load and thus manufacturing costs can be reduced.

In so far as the vehicle headlamp 1 according to the third embodiment is concerned, the light control member 4 and the auxiliary lens section 31 that are positioned in the first location partially overlap each other on top and bottom. Thus, as shown in FIG. 9, if the light control member 4 and the auxiliary lens section 31 are positioned at the lower side, a large upper opening portion WU is obtained at the upper part and a slight lower opening portion WD is formed at the lower side. In this manner, as shown in the solid arrow A in FIG. 9, a heat convection from the lower opening portion WD to the upper opening portion WU is generated. As a result, the heat that is generated in the semiconductor light source 2 (the LED radiant heat), as indicated by the solid arrow B in FIG. 9, can be released from the upper opening portion WU to the outside along the heat convection, and the heat radiation effect can be enhanced.

Fourth Embodiment

Figure 17:
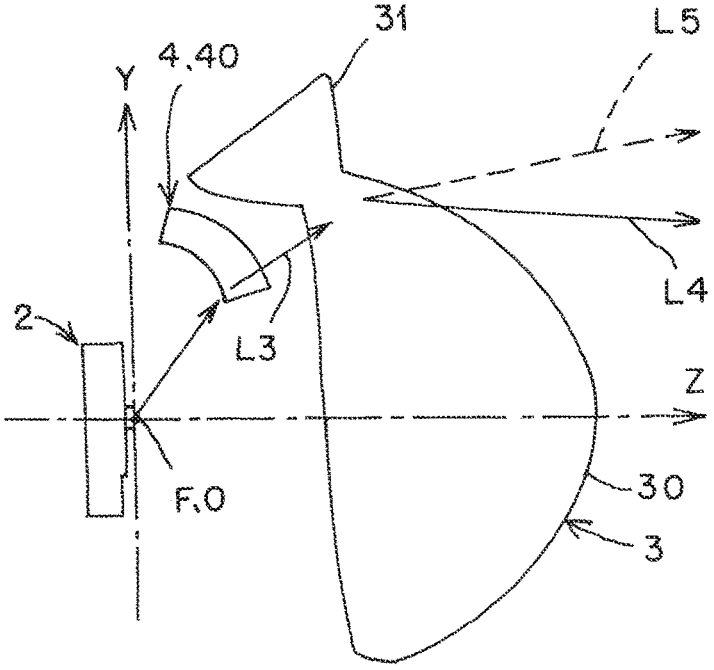
FIG. 17 is an explanatory view showing an optical path when a light control member is positioned in a first location in a fourth embodiment of a vehicle headlamp (an explanatory view corresponding to the sectional view taken along the line IV-IV in FIG. 3).

FIG. 17 shows a fourth embodiment of a vehicle headlamp according to the present invention. Hereinafter, the vehicle headlamp according to the fourth embodiment will be described. In the figure, the same reference numerals in FIG. 1 to FIG. 16 designate the same constituent elements.

The vehicle headlamp 1 of the third embodiment positions the auxiliary lens section 31 at the lower side with respect to the main lens section 30, and positions the first location of the light control member 4 at the lower side; and of the variable focal point lens section 40 of the light control member 4, a portion which is at the reference optical axis Z side of the main lens section 30 is the upper portion 40U, and another portion is the lower portion 40D. On the other hand, the vehicle headlamp according to the fourth embodiment positions the auxiliary lens section 31 at the upper side with respect to the main lens section 30, and positions the first location of the light control member 4 at the upper side; and of the variable focal point lens section 40 of the light control member 4, a portion which is at the reference optical axis Z side of the main lens section 30 is a lower portion, and another portion is an upper portion. In addition, the rotation center O1 of the light control member 4 is positioned at the rear side and at the upper side more significantly than the center O of the light emission surface 23.

The vehicle headlamp according to the fourth embodiment is made of the constituent elements and functions as described above and thus is capable of achieving advantageous effect which is substantially similar to that of the vehicle headlamp 1 of the third embodiment.

Fifth Embodiment

FIG. 18 to FIG. 22 each show a fifth embodiment of a vehicle headlamp according to the present invention. Hereinafter, the vehicle headlamp according to the fifth embodiment will be described. In the figures, the same reference numerals in FIG. 1 to FIG. 17 designate the same constituent elements.

The conventional vehicle headlamp is provided with a light source, a lens, a first reflection surface, and a second reflection surface. In addition, in so far as the conventional vehicle headlamp is concerned, when the first reflection surface is positioned in an open position, light from the light source transmits the lens and then the light is emitted toward the forward direction of the vehicle, as a light distribution for passing beam. Further, when the first reflection surface is positioned in a light shading location, the light from the light source is reflected on the first reflection surface, the thus reflected light is reflected on the second reflection surface, and the thus reflected light is emitted toward the forward direction of the vehicle, as a light distribution pattern for cruising beam.

Thus, in the conventional vehicle headlamp, if the light from an upper portion of the light distribution pattern for cruising beam is insufficient, the visibility of a traffic sign (an overhead sign), a tree, a pedestrian or the like is prone to lower. In addition, if the light from a lower portion of the light distribution pattern for cruising beam is insufficient, a part of the light distribution is missing, splitting of the light distribution or discontinuousness of the light distribution arises, and the visibility of a lateral direction from a front side of the vehicle is prone to lower.

However, in so far as the conventional vehicle headlamp is concerned, means for providing sufficient light to the upper portion and the lower portion of the light distribution pattern for cruising beam is not provided. Thus, in the conventional vehicle headlamp, there may be a case in which a good light distribution pattern for cruising beam is not obtained.

A problem to be solved by the present invention is that, in the conventional vehicle headlamp, there may be a case in which a good light distribution pattern for cruising beam is not obtained.

Figure 19:
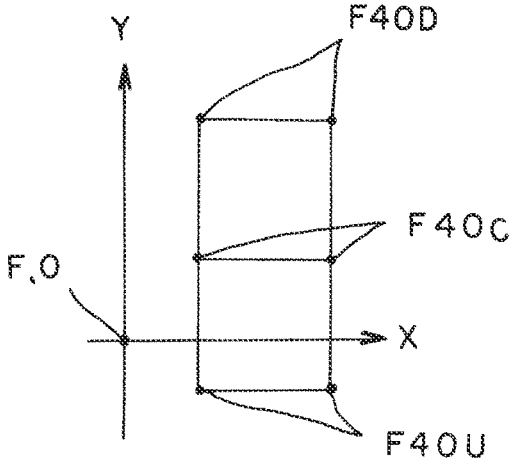
FIG. 19 is an explanatory view showing a position of a focal point of the variable focal point lens section of the light control member.

The present invention, as shown in FIG. 19, is provided with a semiconductor light source 2, a lens 3, a light control member 4, and a drive member 5. The lens 3 is composed of a main lens section 30 and an auxiliary lens section 31. The drive member 5 positions the light control member 4 to be switchable in movement between a first location and a second location. A focal point F40U of an upper portion 40U of the light control member 4 is displaced to a lower side, and a focal point F40D of a lower portion 40D of the light control member 4 is displaced to an upper side. As a result, according to the present invention, a good high-beam light distribution pattern HP is obtained.

Figure 18:
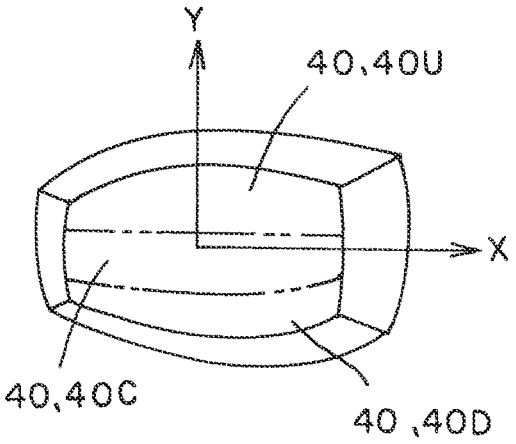
FIG. 18 is a rear view showing a variable focal point lens section in a fifth embodiment of the present invention.

When the light control member 4 is positioned in the first location shown in FIG. 4, the portion 40U that is positioned at the main lens section 30 side, of the variable focal point lens section 40 of the light control member 4, is an upper portion more significantly than the upper double-dotted chain line shown in FIG. 18. When the light control member 4 is positioned in the first location shown in FIG. 4, a portion 40D opposite to the portion 40U that is positioned at the main lens section 30 side, of the variable focal point lens section 40 of the light control member 4, is a lower portion more significantly than the lower double-dotted chain line shown in FIG. 18. Of the variable focal point lens section 40, an intermediate portion 40C is a portion between the upper double-dotted chain line and the lower double-dotted chain line shown in FIG. 18.

The upper portion 40U of the variable focal point lens section 40 continuously displaces the reference focal point F of the main lens section 30 to the lower side (refer to F40U in FIG. 19). The intermediate portion 40C of the variable focal point lens section 40 continuously displaces the reference focal point F of the main lens section 30 to the upper side (refer to F40C in FIG. 19). The lower portion 40D of the variable focal point lens section 40 continuously displaces the reference focal point F of the main lens section 30 to the upper side (refer to F40D in FIG. 19) more significantly than the intermediate portion 40C.

That is, the focal point F40U of the upper portion 40U of the variable focal point lens section 40 of the light control member 4 is displaced to the lower side with respect to a focal point of another portion (the focal point 40C of the intermediate portion 40C and the focal point F40D of the lower portion 40D). On the contrary, the focal point F40D of the lower portion 40D of the variable focal point lens section 40 of the light control member 4 is displaced to the upper side with respect to a focal point of another portion (the focal point 40C of the intermediate portion 40C and the focal point F40D of the upper portion 40U). The focal point F40C of the intermediate portion 40C of the variable focal point lens section 40 of the light control member 4 is neither displaced at the upper side nor the lower sides.

(Description of Functions of Fifth Embodiment)

The vehicle headlamp 1 according to the fifth embodiment is made of the constituent elements as described above, and hereinafter, functions thereof will be described.

At the time of a normal mode, that is, when the solenoid 50 is not powdered on, due to the spring force of the spring 52, the reciprocating rod 54 is positioned in a forward location, and the light control member 4 is positioned in a first location. At this time, the variable focal point lens section 40 of the light control member 4, as shown in FIG. 4, is positioned between the light emission surface 23 of the semiconductor light source 2 and the incidence surface 310 of the auxiliary lens section 31 of the lens 3.

At the time of the normal mode, the light emitting chip 20 of the semiconductor light source 2 is lit. Subsequently, of the light that is radiated from the light emission surface 23 of the light emitting chip 20, the center light L1 and a part of the peripheral light from the semiconductor light source 2, as shown in FIG. 4, is directly made incident into the main lens section 30 from the incidence surface 300 of the main lens section 30 of the lens 3. At this time, the incident light is controlled to be optically distributed in the incidence surface 300. The incident light having been made incident to the main lens section 30 is emitted from the emission surface 301 of the main lens section 30. At this time, the thus emitted light is controlled to be optically distributed in the emission surface 301. The emitted light from the main lens section 30 is emitted toward the forward direction of the vehicle C, as the main light distribution pattern of the low-beam light distribution pattern LP having the lower horizontal cutoff line; the oblique cutoff line, and the upper horizontal cutoff line.

On the other hand, of the light that is radiated from the light emission surface 23 of the light emitting chip 20, another part L2 of the peripheral light from the semiconductor light source 2, as shown in FIG. 4, is made incident into the variable focal point lens section 40 from the incidence surface 40 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the thus emitted light is controlled to be optically distributed in the emission surface 401.

The emitted light from the variable focal point lens section 40 is made incident into the auxiliary lens 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the thus reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31 is emitted toward the forward direction of the vehicle C, as the auxiliary light distribution of the low-beam light distribution pattern LP.

Then, the main light distribution pattern and the auxiliary light distribution pattern are combined (weighted) with each other, and the low-beam light distribution pattern LP shown in FIG. 8 (A) is obtained.

At this time, the focal point F40U of the upper portion 40U of the variable focal point lens section 40, that is, the focal point F40U of the upper portion 40U that is at the reference optical axis Z side of the main lens section 30, of the variable focal point lens section 40, is displaced to the lower side with respect to the focal point F40C of the intermediate portion 40C (and the focal point F40D of the lower portion 40D).

Thus, as shown in FIG. 4, the emitted light L3 having been emitted from the upper portion 40U of the variable focal point lens section 40 is obtained as downward emitted light. Thus, even if the emitted light L3 having been emitted from the upper portion 40U of the variable focal point lens section 40 is made incident to the main lens section 30 in place of the auxiliary lens section 31, the emitted light L4 having been emitted from the main lens section 30 is oriented downward. This downward emitted light L4 is obtained as a part of the low-beam light distribution pattern LP.

Then, power is supplied to the solenoid 40. Afterwards, the reciprocating rod 54 is retracted and then is positioned in the backward location against the spring force of the spring 52, and the light control member 4 rotates from the first location to the second location and then is positioned in the second location. That is, the light control member 4 having been positioned between the semiconductor light source 2 and the auxiliary lens section 31 up to now, as shown in FIG. 5, is positioned between the light emission surface 23 of the semiconductor light source 2 and the incidence surface 300 of the main lens section 30 of the lens 3.

Subsequently, of the light that is radiated from the light emission surface 23 of the light emitting chip 20, the center light L1 of the semiconductor light source 2 is made incident into the variable focal point lens section 40 from the incidence surface 400 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the thus emitted light is controlled to be optically distributed in the emission surface 401.

The emitted light from the variable focal point lens section 40 is made incident into the main lens section 30 from the incidence surface 300 of the main lens section 30. In addition, a part of the peripheral light from the semiconductor light source 2 is directly made incident into the main lens section 30 from the incidence surface 300 of the main lens section 30. At this time, the incident light is controlled to be optically distributed in the emission surface 300. The incident light having been made incident into the main lens section 30 is emitted from the emission surface 301 of the main lens section 30. At this time, the thus emitted light is controlled to be optically distributed in the emission surface 301. The emitted light from the main lens section 30 is emitted toward the forward direction of the vehicle C, as the main light distribution pattern of the high-beam light distribution pattern HP.

On the other hand, of the light that is radiated from the light emission surface 23 of the light emitting chip 20, another part L2 of the peripheral light from the semiconductor light source 2, as shown in FIG. 5, is directly made incident into the auxiliary lens section 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31 is emitted toward the forward direction of the vehicle C, as the auxiliary light distribution pattern of the high-beam light distribution pattern HP.

Then, the main light distribution pattern and the auxiliary light distribution pattern are combined (weighted) with each other, and the high-beam light distribution pattern HP shown in FIG. 8 (B) is obtained.

Figure 20:
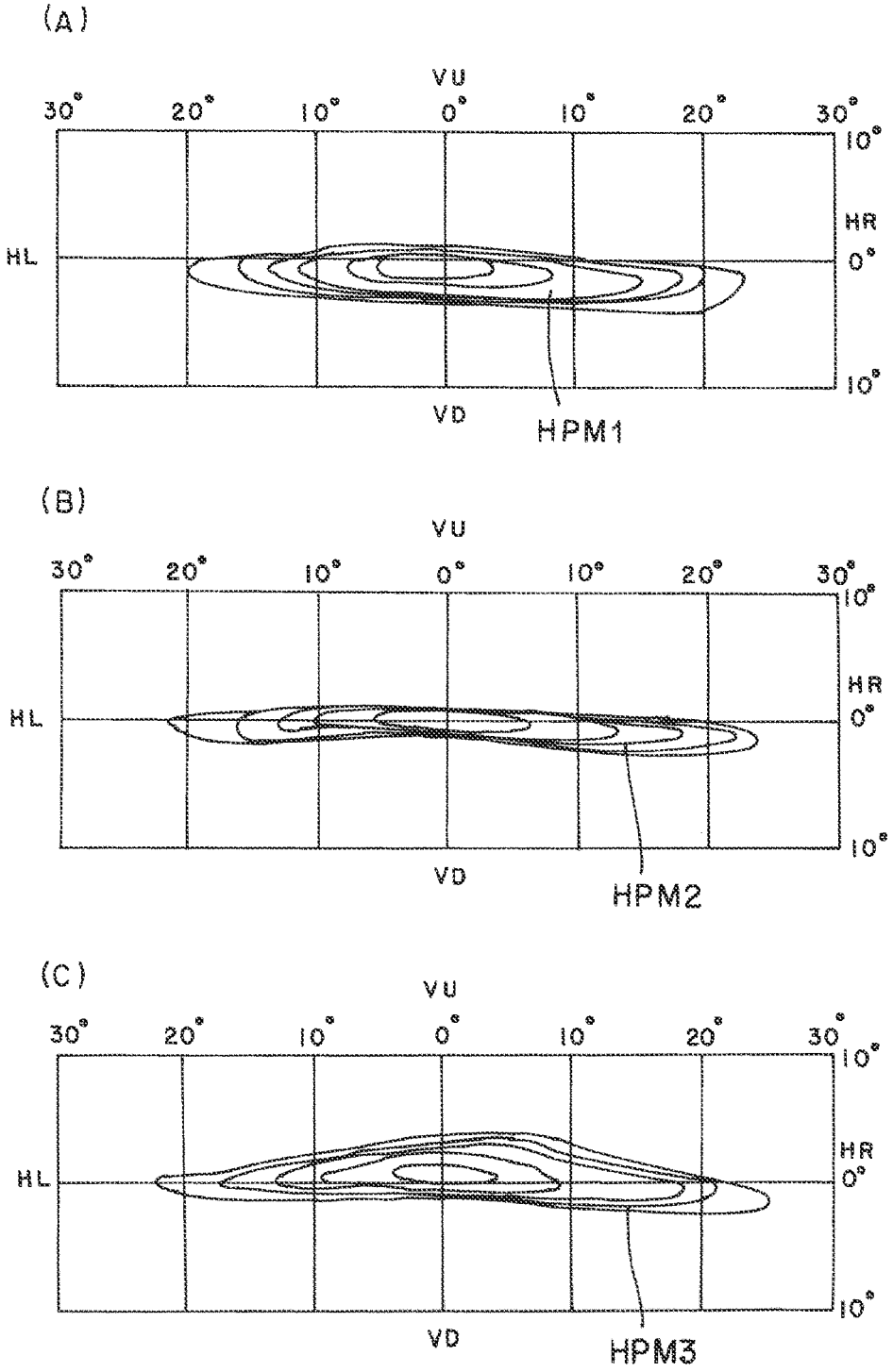
FIG. 20 is an explanatory view showing light distribution patterns which are emitted from an upper portion, an intermediate portion, and a lower portion of the variable focal point lens section of the light control member at the time of emission a high-beam light distribution pattern.

Here, the focal point F40U of the upper portion 40U of the variable focal point lens section 40 is displaced to the lower side with respect to the focal point F40C of the intermediate portion 40C (and the focal point F40D of the lower portion 40D). Thus, the emitted light having been emitted from the upper portion 40U of the variable focal point lens section 40 is obtained as downward emitted light. In this manner, the downward emitted light having been emitted from the upper portion 40U of the variable focal point lens section 40 transmits the main lens section 30 and then is deflected downward. As a result, a first variable light distribution pattern HPM1 which is emitted from the upper portion 40U of the variable focal point lens section 40 and the main lens section 30, as shown in FIG. 20 (A), is diffused to the lower side (blurred to the lower side).

On the contrary, the focal point F40D of the lower portion 40D of the variable focal point lens section 40 is displaced to the upper side with respect to the focal point F40C of the intermediate portion 40 (and the focal point F40U of the upper portion 40U). Thus, the emitted light having been emitted from the lower portion 40D of the variable focal point lens section 40 is obtained as upward emitted light. In this manner, the upward emitted light having been emitted from the lower portion 40D of the variable focal point lens section 40 transmits the main lens section 30 and then is deflected upward. As a result, a third variable light distribution pattern HPM3 which is emitted from the lower portion 40D of the variable lens section 40 and the main lens section 30, as shown in FIG. 20 (C), is diffused to the upper side (blurred to the upper side).

The focal point F40C of the intermediate portion 40C of the variable focal point lens section 40 is not displaced at all. Thus, the emitted light having been emitted from the intermediate portion 40C of the variable focal point lens section 40 is obtained as the emitted light with its orientation being kept unchanged as is. In this manner, the emitted light with its orientation being kept unchanged as is, the light having been emitted from the intermediate portion 40C of the variable focal point lens section 40, transmits the main lens section 30 with its orientation being kept unchanged as is. As a result, a second variable light distribution pattern HPM2 that is emitted from the intermediate portion 40C of the variable focal point lens section 40 and the main lens section 30, as shown in FIG. 20 (B), is not diffused to the upper and lower sides (not blurred to the upper and lower sides).

Figure 21:
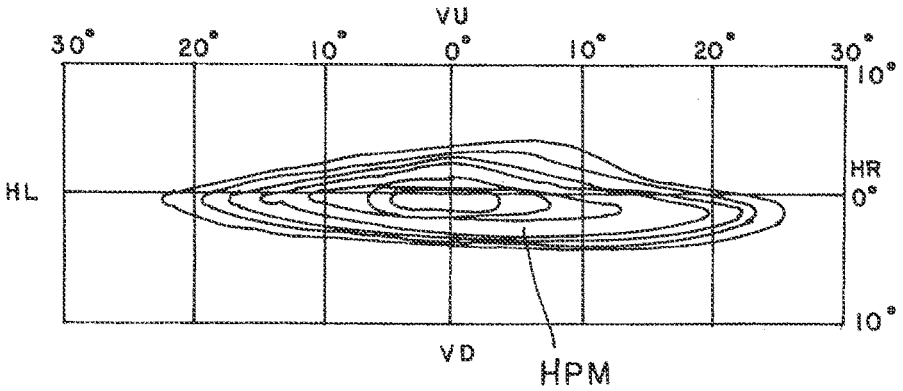
FIG. 21 is an explanatory view showing a light distribution pattern which is emitted from the variable focal point lens section of the light control member at the time of emission of the high-beam light distribution pattern.
Figure 21:
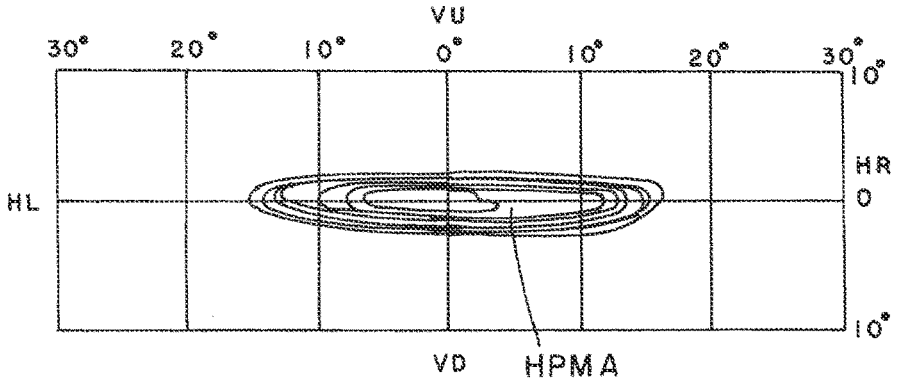

The first variable light distribution pattern HPM1, the second variable light distribution pattern HPM2, and the third variable light distribution pattern HPM13 are combined (weighted) with one another, and a variable light distribution pattern HPM shown in FIG. 21 (A) is obtained. It is to be noted that a variable light distribution pattern HPMA shown in FIG. 21 (B) is a variable light distribution pattern which is obtained in a case where no focal point is displaced and a variable focal point lens section which is fixed is used. Thus, the variable light distribution pattern HPM shown in FIG. 21 (A) is diffused to both of the upper and lower sides with respect to the variable light distribution pattern HPMA shown in FIG. 21 (B) (blurred to both of the upper and lower sides). That is, in so far as the variable light distribution pattern HPM shown in FIG. 21 (A) is concerned, sufficient light is distributed to both of the upper and lower sides.

Figure 22:
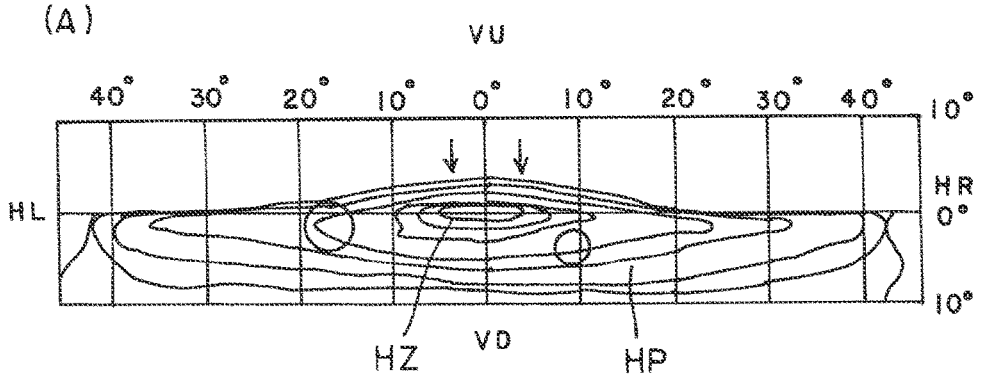
FIG. 22 is an explanatory view of an equi intensity curve of light showing the high-beam light distribution pattern.
Figure 22:
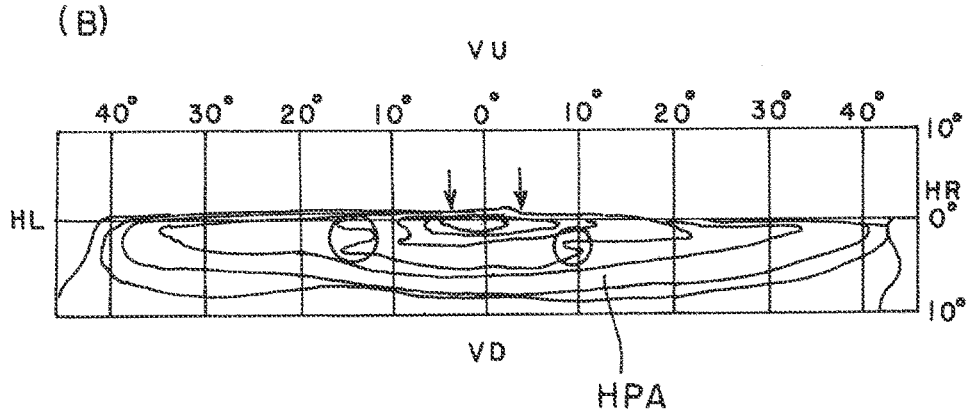

Then, the variable light distribution pattern HPS shown in FIG. 21 (A) and a fixed light distribution pattern which is not shown are combined (weighted) with each other, and a high-beam light distribution pattern HP shown in FIG. 22 (A) is obtained. It is to be noted that a high-beam light distribution pattern HPA shown in FIG. 22 (B) is a high-beam light distribution pattern which is obtained when the variable light distribution pattern HPMA shown in FIG. 21 (B) and the fixed light distribution pattern which is not shown are combined (weighted) with each other. The fixed light distribution pattern is a light distribution pattern which is obtained by subtracting the variable light distribution pattern HPM shown in FIG. 21 (A) from the high-beam light distribution pattern HP shown in FIG. 22 (A). That is, the fixed light distribution pattern is a light distribution pattern other than the variable light distribution pattern HPM that is emitted from the variable focal point lens section 40 and the main lens section 30, and is a fixed light distribution pattern formed by combining (weighting): the fixed light distribution pattern that is emitted from the main lens section 30 without passing through the variable focal point lens section 40; and the fixed light distribution pattern that is emitted from the auxiliary lens section 31 with each other.

Here, in so far as the variable light distribution pattern HPMA shown in FIG. 21 B) is concerned, sufficient light is not distributed to both of the upper and lower sides. Thus, in the high-beam light distribution pattern HPA shown in FIG. 22 (B), the light from the upper portion is insufficient (refer to the arrow in FIG. 22 (B)). Thus, there is a problem in the visibility of a traffic sign (an overhead sign), a tree, a pedestrian or the like. On the other hand, the light from the lower portion is insufficient, a part of the light distribution (refer to the small circle in FIG. 22 (B)) is missing, a splitting of the light distribution arises between the variable light distribution pattern HPMA and the fixed light distribution pattern, and there is a problem in the visibility of the lateral direction from the front side of the vehicle.

On the other hand, in so far as the variable light distribution pattern HPM shown in FIG. 21 (A) is concerned, sufficient light is distributed to both of the upper and lower sides. Thus, in the high-beam light distribution pattern HP shown in FIG. 22 (A), the light from the upper portion is sufficient (refer to the arrow in FIG. 22 (A)). Thus, the visibility of a traffic sign (an overhead sign), a tree, a pedestrian or the like is enhanced. On the other hand, the light from the lower portion is also sufficient, missing of a part of the light distribution (refer to the small circle in FIG. 22 (A)) is prevented, splitting of the light distribution is eliminated between the variable light distribution pattern HPM and the fixed light distribution pattern, and the visibility of the lateral direction from the front side of the vehicle is enhanced.

Afterwards, power supply to the solenoid 50 is shut off. Then, the reciprocating rod 54 is advanced and is positioned in the forward location due to the spring force of the spring 52, and the light control member 4 rotates from the second location to the first location and is positioned in the first location. That is, the light control member 4 having been positioned between the semiconductor light source 2 and the main lens section 30 up to now is positioned between the semiconductor light source 2 and the auxiliary lens section 31.

(Description of Advantageous Effect of Fifth Embodiment)

The vehicle headlamp 1 according to the fifth embodiment is made of the constituent elements and functions as described above, and hereinafter, advantageous effect thereof will be described.

In so far as the vehicle headlamp 1 according to the fifth embodiment is concerned, the focal point F40U of the upper portion 40U of the variable focal point lens section 40 of the light control member 4 is displaced to the lower side with respect to the focal points F40C, F40U of other portions 40C, 40D. Thus, as shown in FIG. 5, when the light control member 4 is positioned in the second location, the emitted light having been emitted from the upper portion 40U of the variable focal point lens section 40 of the light control member 4 is obtained as downward emitted light. On the other hand, the focal point of the lower portion 40D of the variable focal point lens section 40 of the light control member 4 is displaced to the upper side with respect to the focal points F40C, F40U of other portions 40 of the light control member 4. Thus, as shown in FIG. 5, when the light control member 4 is positioned in the second location, the emitted light having been emitted from the lower portion 40D of the variable focal point lens section 40 of the light control member 4 is obtained as upward emitted light. In this manner, the upward emitted light having been emitted from the variable focal point lens section 40 of the light control member 4 transmits the main lens section 30 of the lens 3 and is deflected upward, whereas the downward emitted light having been emitted from the variable focal point lens section 40 of the light control member 4 transmits the main lens section 30 of the lens 3 and is deflected downward. As a result, the light from the upward portion of the high-beam light distribution pattern HP is sufficient, and the visibility of a traffic sign (an overhead sign), a tree, a pedestrian or the like can be enhanced. In addition, the light from the lower portion of the high-beam light distribution pattern HP is sufficient, and the visibility of the lateral direction from the front side of the vehicle can be enhanced. Thus, a good high-beam light distribution pattern is obtained.

In so far as the vehicle headlamp 1 according to the fifth embodiment is concerned, the focal point F40C of the intermediate portion 40C of the variable focal point lens section 40 is neither displaced to the upper side nor lower side. Thus, the emitted light having been emitted from the intermediate portion 40C of the variable focal point lens section 40 is obtained as the emitted light with its orientation being kept unchanged as is. In this manner, the emitted light with its orientation being kept unchanged as is, the light having been emitted from the intermediate portion 40C of the variable focal point lens section 40, transmits the main lens section 30 with its orientation being kept unchanged as is. As a result, the second variable light distribution pattern HPM2 that is emitted from the intermediate portion 40C of the variable focal point lens section 40 and the main lens section 30, as shown in FIG. 20 (B), is not diffused to the upper and lower sides (not blurred to the upper and lower sides). In this manner, a hot zone (high intensity of light zone) HZ is obtained at the central portion of the high-beam light distribution pattern HP, and distal the visibility is ensured.

In so far as the vehicle headlamp 1 according to the fifth embodiment is concerned, the focal point F40U of the upper portion 40U that is at the reference optical axis's side of the main lens section 30, of the variable focal point lens section 40 of the light control member 4, is displaced to the lower side with respect to the focal point D40D of the lower portion 40D that is another portion. Thus, as shown in FIG. 4, when the light control member 4 is positioned in the first location, the emitted light L3 having been emitted from the upper portion 40U of the variable focal point lens section 40 is obtained as downward emitted light. Thus, even if the emitted light L3 having been emitted from the upper portion 40U of the variable focal point lens section 40 is made incident to the main lens section 30 in place of the auxiliary lens section 31, the emitted light L4 having been emitted from the main lens section 30 is oriented downward. This downward emitted light L4 is obtained as a part of the low-beam light distribution pattern. As a result, the generation of stray light can be prevented.

Here, a case in which the focal point of the upper portion 40U of the variable focal point lens section 40 is not displaced at all or is displaced to the upper side, with respect to the focal point of the lower portion 40D, will be described. In this case, the emitted light having been emitted from the upper portion 40 of the variable focal point lens section 40 is not obtained as downward emitted light. Thus, if the emitted light having been emitted from the upper portion 40U of the variable focal point lens section 40 is made incident to the main lens section 30, there may be a case in which the emitted light L5 having been emitted from the main lens section 30 is oriented upward (refer to the dashed arrow in FIG. 4). As a result, the generation of stray light cannot be prevented. On the other hand, in so far as the vehicle headlamp 1 according to the fifth embodiment is concerned, as described previously, the generation of stray light can be prevented.

In so far as the vehicle headlamp 1 according to the fifth embodiment is concerned, when the light control member 4 is positioned in the first location, a part of the light from the semiconductor light source 2 (the center light L1 and a part of the peripheral light) is directly made incident to the main lens section 30 of the lens 3 and the residue of the light from the semiconductor light source 2 (another part L2 of the peripheral light) is made incident to the auxiliary lens section 31 of the lens 3 via the light control member 4 and then from the lens 3, the low-beam light distribution pattern LP is emitted toward the forward direction of the vehicle C. In addition, when the light control member 4 is positioned in the second location, a part of the light from the semiconductor light source 2 (the center light L1) is made incident to the main lens section 30 of the lens 3 via the light control member 4 and a part of the light from the semiconductor light source 2 (a part of the peripheral light) is directly made incident to the main lens section 30 of the lens 3 and the residue of the light from the semiconductor light source 2 (another part L2 of the peripheral light) is directly made incident to the auxiliary lens section 31 of the lens 2 and then from the lens 3, the high-beam light distribution pattern HP is emitted toward the forward direction of the vehicle C, as a result, in the light emission lens-type lamp unit, the low-beam light distribution pattern LP and the high-beam light distribution pattern HP are reliably obtained.

In so far as the vehicle headlamp 1 according to the fifth embodiment is concerned, when the light control member 4 is positioned in the first location, a part of the light from the semiconductor light source 2 (the center light L1 and a part of the peripheral light) is directly made incident to the main lens section 30 and the residue of the light from the semiconductor light source 2 (another part L2 of the peripheral light) is made incident to the auxiliary lens section 31 via the light control member 4 and thus the light from the semiconductor light source 2 (the center light L1 and a part of the peripheral light or another part of the peripheral light L2) can be effectively utilized. In addition, when the light control member 4 is positioned in the second location, a part of the light from the semiconductor light source 2 (the center light L1) is made incident to the main lens section 30 via the light control member 4 and a part of the light from the semiconductor light source 2 (a part of the peripheral light) is directly made incident to the main lens section 30 and the residue of the light from the semiconductor light source 2 (another part L2 of the peripheral light) is directly made incident to the auxiliary lens section 31 and thus the light from the semiconductor light source 2 (the center light L1 and a part of the peripheral light or another part L2 of the peripheral light) can be effectively utilized.

The vehicle headlamp 1 according to the fifth embodiment moves and switches the light control member 4 as one component between the first location and the second location by way of the drive member 5. Thus, the position precision of the first location and the second location of the light control member 4 can be enhanced. Moreover, it is sufficient if the drive member 5 is inexpensive and low in output, for example, the solenoid 50 with its low output and the spring 52 with its small spring load and thus manufacturing costs can be reduced.

In so far as the vehicle headlamp 1 according to the fifth embodiment is concerned, the light control member 4 rotates between the first location and the second location by way of the drive member 5, and the rotation center O1 of the light control member 4 is positioned at the rear side more significantly than the light emission surface 3 of the semiconductor light source 2. Thus, as shown in FIG. 10, the rotation angle θ1 of the light control member 4 can be reduced in comparison with the rotation angle θ2 in a case where the center O of the light emission surface 23 is defined as a rotation center of the light control member 4. In this manner, the drive member 5 can be downsized and low in output and thus downsizing and cost reduction of the unit can be achieved.

In so far as the vehicle headlamp 1 according to the fifth embodiment is concerned, the auxiliary lens section 31 is disposed at the lower side with respect to the main lens section 30. Thus, when the drive member 5 is not driven, if the light control member 4 is positioned in the first location, the light control member 4 can be stopped at the lower side, that is, in the gravitational direction. In this manner, it is sufficient if the drive member 5 is inexpensive and low in output, for example, the solenoid 50 with its low output and spring 52 with its small spring load and thus manufacturing costs can be reduced.

In so far as the vehicle headlamp 1 according to the fifth embodiment is concerned, the light control member 4 and the auxiliary lens section 31 that are positioned in the first location partially overlaps with each other on top and bottom. Thus, as shown in FIG. 9, if the light control member 4 and the auxiliary lens section 31 are positioned at the lower side, a large upper opening portion WU is obtained at the upper part and a slight lower opening portion WD is formed at the lower part. In this manner, as indicated by the solid arrow A in FIG. 9, a heat convection from the lower opening portion WD to the upper opening portion WU is generated. As a result, a heat which is generated in the semiconductor light source 2 (an LED radiant heat), as indicated by the solid arrow B in FIG. 9, can be released from the upper opening portion WU to the outside along the heat convection, and the heat radiation effect can be enhanced.

Sixth Embodiment

Figure 23:
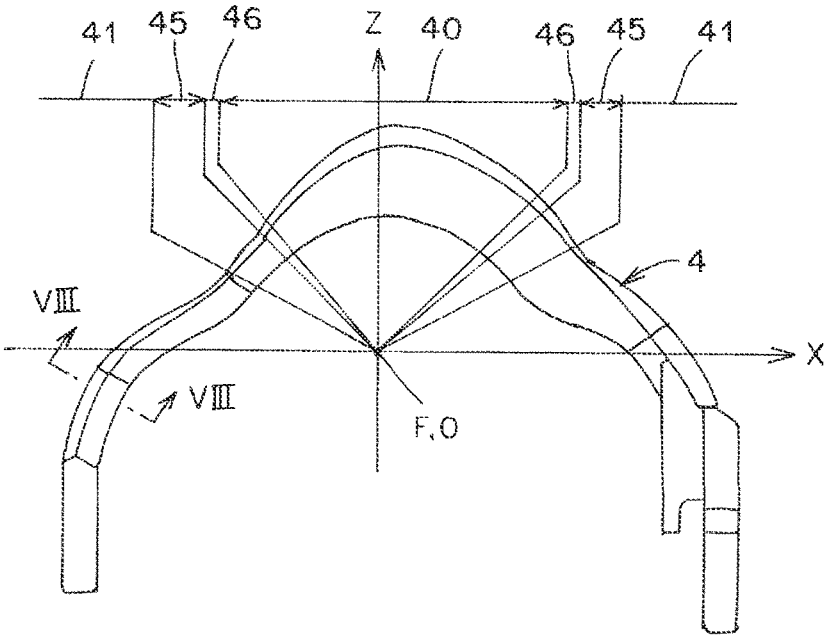
FIG. 23 is a plan view showing entirety of a light control member in a sixth embodiment of the present invention.
Figure 24:
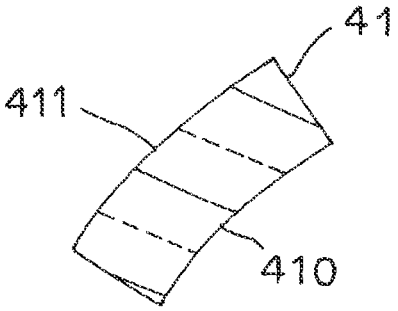
FIG. 24 is a sectional view taken along the line VIII-VIII in FIG. 23.
Figure 25:
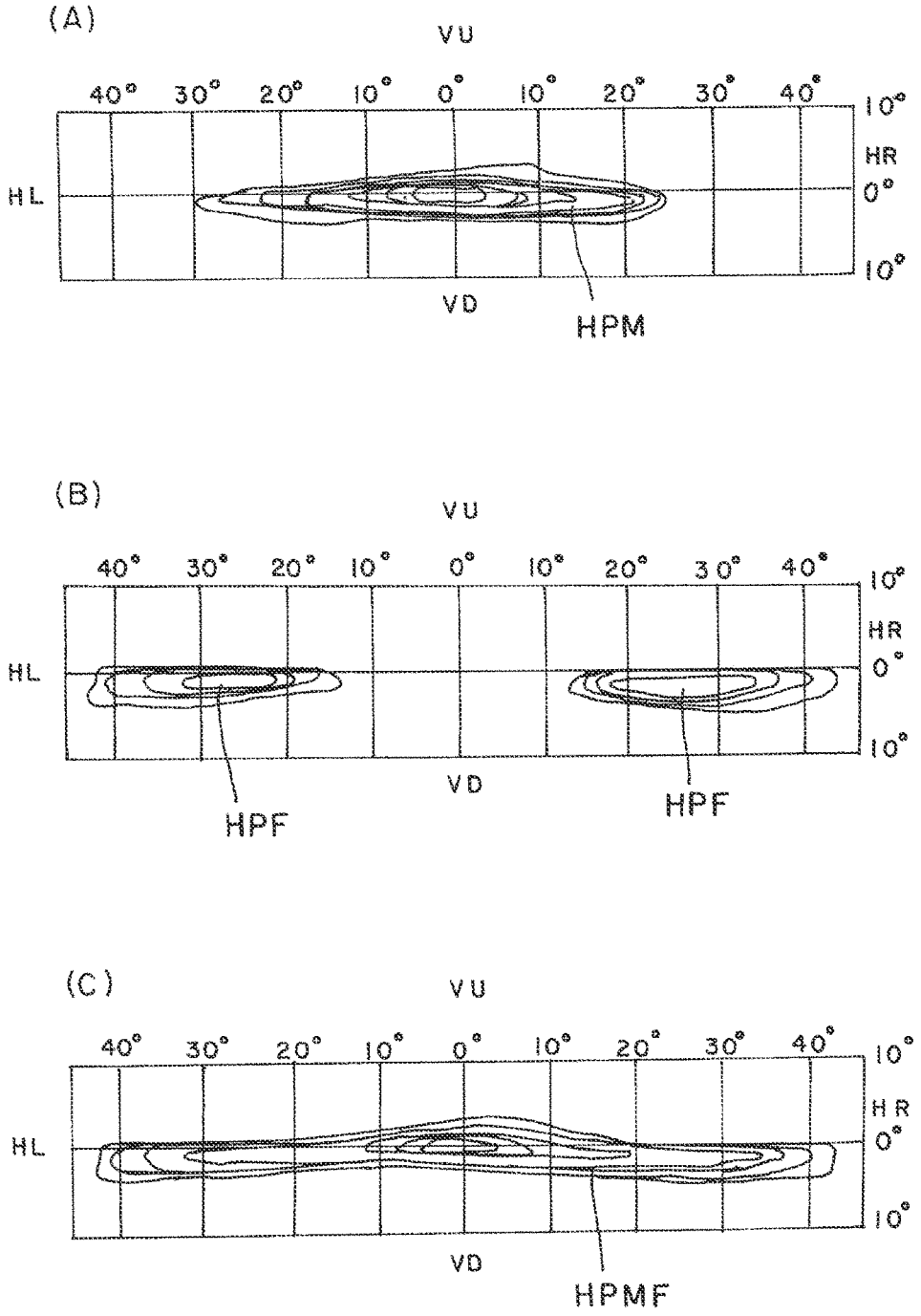
FIG. 25 is an explanatory view showing light distribution patterns to which are emitted from the variable focal point lens section and a fixed focal point lens section of the light control member at the time of emission of the high-beam light distribution pattern.

FIG. 23 to FIG. 25 each show a sixth embodiment of a vehicle headlamp according to the present invention. Hereinafter, the vehicle headlamp according to the sixth embodiment will be described. In the figures, the same reference numerals in FIG. 23 to FIG. 25 designate the same constituent elements.

The conventional headlamp is provided with: a light source; a lens; a first reflection surface; and a second reflection surface. In addition, in so far as the conventional headlamp is concerned, when the first reflection surface is positioned in an open location, light from the light source transmits the lens and then the light is emitted toward the forward direction of the vehicle, as a light distribution pattern for passing beam. In addition, when the first reflection surface is positioned in a light shading location, the light from the light source is reflected on the first reflection surface, the thus reflected light is reflected on the second reflection surface, and the thus reflected light is emitted toward the forward direction of the vehicle, as a light distribution pattern for cruising beam.

Thus, in the conventional vehicle headlamp, there is a need to emit the light distribution pattern for passing beam and the light distribution pattern for cruising beam with high precision by using a first reflection surface which is movable.

A problem to be solved by the present invention is that there is a need to emit the light distribution pattern for passing beam and the light distribution pattern for cruising beam with high precision.

The present invention, as shown in FIG. 23, is provided with: a semiconductor light source 2; a lens 3; a light control member 4; and a drive member 5. The lens 3 is composed of: a main lens section 30; and an auxiliary lens section 31. The drive member 5 positions the light control member 4 to be switchable between the first location and the second location. The light control member 4 is provided with: a movable focal point lens section 40; and a fixed focal point lens section 45. As a result, the present invention is capable of emitting the low-beam light distribution pattern LP and the high-beam light distribution pattern HP with high precision.

(Description of Light Control Member 4)

The light control member 4, as shown in FIG. 23, is provided with: a variable focal point lens section 40; a mounting section 41; a fixed focal point lens section 45; and a gradually variable focal point lens section 46. The light control member 4 is composed of a light transmission member, and forms an integral structure.

The variable focal point lens section 40 is provided at a central portion. The mounting section 41 is provided at each of the left and right sides. The fixed focal point lens section 45 is provided between the variable focal point lens section 40 and the mounting section 41 and at the mounting section 41 side. The gradually variable focal point lens section 46 is provided between the variable focal point lens section 40 and the fixed focal point lens section 45.

The mounting section 41 is positioned and mounted to the base member 8 via the bearing member 7. As a result, the light control member 4 is mounted to the base member 8 via the bearing member 7 so as to be rotatable between the first location and the second location. The rotation center O1 of the light control member 4 is positioned at the rear side and at the lower side more significantly than the center O of the light emission surface 23.

The light control member 4 is configured to be switchable in movement (rotation) between the first location and the second location by way of the drive member 5. The first location, as shown in FIG. 4, is a location in which the variable focal point lens section 40 is positioned between the light emission surface 23 of the semiconductor light source 2 and the incidence surface 31 of the auxiliary lens section 31. The second location, as shown in FIG. 5, is a location in which the variable focal point lens section 40 is positioned between the light emission surface 23 of the semiconductor light source 2 and the central portion to which the center light L1 of the incidence surface 300 of the main lens section 30 is made incident. When the light control lens section 4 is positioned in the second location, as shown in FIG. 23, the variable focal point lens section 40, the mounting section 41, the fixed focal point lens section 45, and the gradually variable focal point lens section 46 are arranged in parallel to one another in the X-axis direction.

The variable focal point lens section 40 of the light control member 4 that is positioned in the first location and the auxiliary lens section 31 of the lens 3, as shown in FIG. 4, partially (mostly) overlap each other on the top and bottom. As a result, between the semiconductor light source 2 and a lower part of the lens 3 and the light control member 4, a slight opening portion (a lower opening portion) is formed.

(Description of Variable Focal Point Lens Section 40)

The variable focal point lens section 40, when positioned in the first location, as shown in FIG. 4, transmits another part L2 of the peripheral light and then makes it incident into the auxiliary lens section 31. As a result, the auxiliary light distribution pattern of the low-beam light distribution pattern LP is emitted to the forward direction of the vehicle C from the emission surface 312 of the auxiliary lens section 31.

The variable focal point lens section 40, when positioned in the second location, as shown in FIG. 5, transmits the center light L1 and then make the transmitted light incident into the central portion of the main lens section 30. As a result, the variable light distribution pattern HPM (refer to FIG. 25 (A)), that is a part of the main light distribution pattern of the high-beam light distribution pattern HP, is emitted toward the forward direction of the vehicle C from the central portion of the emission surface 301 of the main lens section 30. The variable light distribution pattern HPM is formed by deflecting a portion of the main light distribution pattern of the low-beam light distribution pattern LP.

Of the variable focal point lens section 40 of the light control member 4, when positioned in the first location shown in FIG. 4, the focal point F40U of the upper portion 40U (the upper portion more significantly than the upper double-dotted chain line shown in FIG. 18), that is at the reference optical axis Z side of the main lens section 30, is displaced to the lower side with respect to the focal points F40C, F40D of other portions 40C, 40D. On the contrary, of the variable focal point lens section 40 of the light control member 4, when positioned in the first location shown in FIG. 4, the focal point D40D of the lower portion (the lower portion more significantly than the double-dotted chain line shown in FIG. 18) 40D that is opposite to the reference optical axis Z side of the main lens section 30 is displaced with respect to the focal points F40C, F40D of other portions 40C, 40D. The focal point F40C of the intermediate portion 40C between the upper and lower sides of the variable focal point lens section 40 of the light control member 4 is neither displaced to the upper side nor the lower side (direction).

The focal point F40U of the upper portion 40U, as shown in FIG. 19, is continuously displaced to the lower side with respect to the focal point F40C of the intermediate portion 40 (and the focal point F40C of the lower portion 40D). On the contrary, the focal point F40D of the lower portion 40D, as shown in FIG. 19, is continuously displaced to the upper side with respect to the focal point F40C of the intermediate portion 40C (and the focal point F40U of the upper portion 40U). The focal point F40C of the intermediate potion 40C, as shown in FIG. 19, is neither displaced to the upper side nor the lower side (directions).

(Description of Fixed Focal Point Lens Section 45 and Gradually Variable Focal Point Lens Section 46)

The fixed focal point lens section 45 and the gradually variable focal point lens section 46, when positioned in the second location, are positioned between the light emission surface 23 of the semiconductor light source 2 and a portion at each of the left and right sides of the central portion to which the center light L1 of the incidence surface 300 of the main lens section 30 is made incident. The fixed focal point lens section 45 transmits a part of the peripheral light with its transparent state being kept unchanged as is, without being deflected, and then makes it incident into the portions at each of the left and right sides of the central portion of the main lens section 30. As a result, a fixed light distribution pattern HPF (refer to FIG. 25 (B)), which is a part of the main light distribution pattern of the high-beam light distribution pattern HP, is emitted toward the forward direction of the vehicle C from the portion at each of the left and right sides of the central portion of the emission surface 301 of the main lens section 30. The fixed light distribution pattern HPF is formed without deflecting the portion that is emitted toward the lateral direction of the main light distribution pattern of the low-beam light distribution pattern LP.

The gradually variable focal point lens section 46 transmits a part of the peripheral light in a gradually varied state from a deflected state of the variable focal point lens section 40 to a fixed state of the fixed focal point lens section 45 or from the fixed state of the fixed focal point lens section 45 to the deflected state of the variable focal point lens section 40, and makes it incident into the portion at each of the left and right sides of the central portion of the main lens section 30. As a result, a gradually variable light distribution pattern (not shown) between the variable light distribution pattern HPM and the fixed light distribution patter HPF that are part of the main light distribution pattern of the high-beam light distribution pattern HP is emitted toward the forward direction of the vehicle C from the portion at each of the left and right sides of the central portion of the emission surface 301 of the main lens section 30. It is to be noted that the gradually variable light distribution pattern is formed between each of the left and right end parts of the variable light distribution pattern HPM and a respective one of a right end part of the fixed light distribution pattern HPF at the left side and a left end part of the fixed light distribution pattern HPF at the right side.

A focal point of the fixed focal point lens section 45, as shown in FIG. 19, is positioned at or near the reference focal point F, and is fixed with respect to the reference focal point F. A focal point of the gradually variable focal point lens section 46, as indicated by the straight line inclined in FIG. 19, is gradually varied between the focal point of the fixed focal point lens section 45 that is fixed with respect to the reference focal point F and a respective of the focal points F40C, F40D, F40U of the variable focal point lens section 40.

(Description of Mounting Section 41)

A horizontal sectional shape (a transverse sectional shape) of the light control member 4, as shown in FIG. 23, forms a substantial arc shape about or near the reference focal point F. In particular, a horizontal sectional shape (a transverse sectional shape) of the mounting section 41 is close to a substantial arc shape. Of the light control member 4, at least a perpendicular sectional shape (a longitudinal sectional shape) of the mounting section 41 forms the shape as shown in FIG. 24. That is, an interior surface 410 that is a surface opposing to the semiconductor light source 2 of the mounting section 41 forms a concave surface which is recessed with respect to the semiconductor light source 2. In addition, an exterior surface 411 which is an opposite surface to the surface opposing to the semiconductor light source 2 of the mounting section 41 forms a convex surface that protrudes to the opposite side to the semiconductor light source 2. The mounting section 41 forms a shape like a part of a tire shape. Although the variable focal point lens section 40 forms a thick shape, the mounting section 41 forms a thin shape. As a result, the mounting section 41 is rotatably mounted to the bearing member 7 by elastic engagement (snap-fit).

(Description of Functions of Sixth Embodiment)

The vehicle headlamp 1 according to the sixth embodiment is made of the constituent elements as described above, and hereinafter, functions thereof will be described.

At the time of a normal mode, that is, when the solenoid 50 is not powered on, due to the spring force of the spring 52, the reciprocating rod 54 is positioned in a forward location, and the light control member 4 is positioned in a first location. At this time, the variable focal point lens section 40 of the light control member 4, as shown in FIG. 4, is positioned between the light emission surface 23 of the semiconductor light source 2 and the incidence surface 310 of the auxiliary lens section 31 of the lens 3.

At the time of the normal mode, the light emitting chip 20 of the semiconductor light source 2 is lit. Subsequently, of the light that is radiated from the light emission surface 23 of the light emitting chip 20, the center light L1 and a part of the peripheral light of the semiconductor light source 2, as shown in FIG. 4, is directly made incident into the main lens section 30 from the incidence surface 300 of the main lens section 30 of the lens 3. At this time, the incident light is controlled to be optically distributed in the incidence surface 300. The incident light having been made incident into the main lens section 30 is emitted from the emission surface 301 of the main lens section 30. At this time, the thus emitted light is controlled to be optically distributed in the emission surface 301. The emitted light from the main lens section 30 is emitted toward the forward direction of the vehicle C, as the main light distribution pattern of the low-beam light distribution pattern LP having: the lower horizontal cutoff line; the oblique cutoff line; and the upper cutoff line.

On the other hand, of the light that is radiated from the light emission surface 23 of the light emitting chip 20, another part L2 of the peripheral light of the semiconductor light source 2, as shown in FIG. 4, is made incident into the variable focal point lens section 40 from the incidence surface 40 of the variable focal point lens section 40 of the light control member 4. At this time, the incident light is controlled to be optically distributed in the incidence surface 400. The incident light having been made incident into the variable focal point lens section 40 is emitted from the emission surface 401 of the variable focal point lens section 40. At this time, the thus emitted light is controlled to be optically distributed in the emission surface 401.

The emitted light from the variable focal point lens section 40 is made incident into the auxiliary lens section 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the thus reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31 is emitted toward the forward direction of the vehicle C, as the auxiliary light distribution pattern of the low-beam light distribution pattern LP.

Then, the main light distribution pattern and the auxiliary light distribution pattern are combined (weighted) with each other, and the low-beam light distribution pattern LP shown in FIG. 8 (A) is obtained.

Afterwards, power is supplied to the solenoid 50. Then, the reciprocating rod 54 is retracted and is positioned in a backward position against the spring force of the spring 52, and the light control member 4 rotates from the first location to the second location and then is positioned in the second location. That is, the light control member 4 having been positioned between the semiconductor light source 2 and the auxiliary lens section 31 up to now, as shown in FIG. 5, is positioned between the light emission surface 23 of the semiconductor light source 2 and the incidence surface 300 of the main lens section 30 of the lens 3.

Subsequently, of the light that is radiated from the light emission surface 23 of the light emitting chip 20, the center light L1 of the semiconductor light source 2 is controlled to be optically distributed, and is made incident, from the incidence surface 400 of the variable focal point lens section 40 of the light control member 4, and the incident light is controlled to be optically distributed, and is emitted, from the emission surface 401.

The emitted light from the variable focal point lens section 40 is deflected, and is controlled to be optically distributed, and is made incident, from the incidence surface 300 of the central portion of the main lens section 30, and the incident light is controlled to be optically distributed, and is emitted from, the emission surface 301. The emitted surface from the central portion of the main lens section 30 is emitted toward the forward direction of the vehicle C, as the variable light distribution pattern HPM that is a part of the main light distribution pattern of the high-beam light distribution pattern HP that has deflected a part of the main light distribution pattern of the low-beam light distribution pattern LP.

In addition, of the light that is radiated from the light emission surface 23 of the light emitting chip 20, a part of the peripheral light of the semiconductor light source 2 transmits the inside of the fixed focal point lens 45 at each of the left and right sides of the variable focal point lens section 40 of the light control member 4 with its transparent state being kept unchanged as is, without any deflection. The transmitted light is made incident into the portion at each of the left and right sides of the central portion of the main lens section 30. At this time, the incident light is controlled to be optically distributed in the incidence surface 300. The incident light having been made incident to the portion at each of the left and right sides of the central portion of the main lens section 30 is emitted from the emission surface 301 of the portion at each of the left and right sides of the central portion of the main lens section 30. At this time, the thus emitted light is controlled to be optically distributed in the emission surface 301. The emitted light from the portion at each of the left and right sides of the central part of the main lens section 30 is emitted toward the forward direction of the vehicle C, as the fixed light distribution pattern HPF that is a part of the main light distribution pattern of the high-beam light distribution pattern HP that has not deflected the residual portion of the main light distribution pattern of the low-beam light distribution pattern LP.

Further, of the light that is radiated from the light emission surface 23 of the light emitting chip 20, a part of the peripheral light of the semiconductor light source 2 deflects and transmits, at a deflection angle which is smaller than that in the variable focal point lens section 40, the inside of the gradually variable focal point lens section 46 between the variable focal point lens section 40 and the fixed focal point lens section 45 of the light control member 4. The transmitted light is made incident into the portion at each of the left and right sides of the central portion of the main lens section 30. At this time, the incident light is controlled to be optically distributed in the incidence surface 300. The incident light having been made incident into the portion at each of the left and right sides of the central portion of the main lens section 30 is emitted from the emission surface 301 of the portion at each of the left and right sides of the central portion of the main lens section 30. At this time, the thus emitted light is controlled to be optically distributed in the emission surface 301. The emitted light from the portion at each of the left and right sides of the central portion of the main lens section 30 is emitted toward the forward direction of the vehicle C, as the gradually variable light distribution pattern that is a part of the main light distribution pattern of the high-beam light distribution pattern HP that is obtained by deflecting the residual part of the main light distribution pattern of the low-beam light distribution pattern LP at a deflection angle which is smaller than a deflection angle at which the inside of the variable focal point lens section 40 is transmitted.

The variable light distribution pattern HPM, the fixed light distribution pattern HPF, and the gradually variable light distribution pattern are combined (weighted) with one another, and the combined pattern is emitted toward the forward direction of the vehicle C, as a combined light distribution pattern HPMF which is a part of the main light distribution pattern of the high-beam light distribution pattern HP (refer to FIG. 25 (C)).

Furthermore, a part of the peripheral light of the semiconductor light source 2 is directly made incident into the main lens section 30 from the incidence surfaces 300 of the upper portion and the lower portion of the main lens section 30. At this time, the incident light is controlled to be optically distributed in the emission surface 300. The incident light having been made incident into of the upper portion and the lower portion of the main lens section 30 is emitted from the emission surface 301 of the main lens section 30. At this time, the thus emitted light is controlled to be optically distributed in the emission surface 301. The emitted light from the upper portion and the lower portion of the main lens section 30 is emitted toward the forward direction of the vehicle C, together with the combined light distribution pattern HPMF, as a part of the main light distribution pattern of the high-beam light distribution pattern HP.

On the other hand, of the light that is radiated from the light emission surface 23 of the light emitting chip 20, another part L2 of the peripheral light of the semiconductor light source 2, as shown in FIG. 5, is directly made incident into the auxiliary lens section 31 from the incidence surface 310 of the auxiliary lens section 31. At this time, the incident light is controlled to be optically distributed in the incidence surface 310. The incident light having been made incident into the auxiliary lens section 31 is fully reflected on the reflection surface 311 of the auxiliary lens section 31. At this time, the thus reflected light is controlled to be optically distributed in the reflection surface 311. The reflected light having been fully reflected is emitted from the emission surface 312. At this time, the thus emitted light is controlled to be optically distributed in the emission surface 312. The emitted light from the auxiliary lens section 31 is emitted toward the forward direction of the vehicle C, as the auxiliary light distribution pattern of the high-beam light distribution pattern HP.

Then, the main light distribution pattern and the auxiliary light distribution pattern are combined (weighted) with each other, and the high-beam light distribution pattern HP shown in FIG. 8 (B) is obtained. It is to be noted that the light having been made incident to the mounting section 41 of the light control member 4 transmits it as is, and is shaded in the lens covering member 6 and thus the incident light is not emitted to the outside.

Then, power supply to the solenoid 50 is shut off. Then, the reciprocating rod 54 is forward and is positioned in the forward location due to the spring force of the spring 52, and the light control member 4 rotates from the second location to the first location and then is positioned in the first location. That is, the light control member 4 having been positioned between the semiconductor light source 2 and the main lens section 30 up to now is positioned between the semiconductor light source 2 and the auxiliary lens section 31.

(Description of Advantageous Effect of Sixth Embodiment)

The vehicle headlamp 1 according to the sixth embodiment is made of the constituent elements and functions as described above, and hereinafter, advantageous effect thereof will be described.

The vehicle headlamp 1 according to the sixth embodiment is capable of deflecting a part of the low-beam light distribution pattern LP at the time of emission of the high-beam light distribution pattern HP by the variable focal point lens section 40 of the light control member 4. In addition, by the fixed focal point lens section 45 of the light control member 4, the portion that is emitted toward the lateral direction of the low-beam light distribution pattern LP at the time of emission of the high-beam light distribution pattern HP can be disallowed to be deflected. In this manner, the high-beam light distribution pattern HP and the low-beam light distribution pattern LP can be emitted with high precision.

That is, in the light control member in which only the variable focal point lens section is provided and the fixed focal point lens section is not provided, at the time of emission of the high-beam light distribution pattern, a boundary between the portions at which the low-beam light distribution pattern is deflected and is not deflected becomes unclear, and there may be a case in which the high-beam light distribution pattern with high precision is not obtained. On the contrary, in so far as the vehicle headlamp 1 according to the sixth embodiment is concerned, the fixed focal point lens section 45 that disallows deflection of a part of the low-beam light distribution pattern LP is provided. Thus, at the time of emission of the high-beam light distribution pattern HP, the boundary between the portions at which the low-beam light distribution pattern LP is deflected and is not deflected can be made clear, and the high-beam light distribution pattern HP with high precision can be obtained.

In so far as the vehicle headlamp 1 according to the sixth embodiment is concerned, the gradually variable focal point lens section 46 is provided between the variable focal point lens section 40 and the fixed focal point lens section 45. Thus, a connection between the variable light distribution pattern HPM that is obtained by the variable focal point lens section 40 and the fixed light distribution pattern HPF that is obtained by the fixed focal point lens section 45 can be smoothly made by the gradually variable light distribution pattern that is obtained by the gradually variable focal point lens section 46. In this manner, a good combined light distribution pattern HPMF is obtained and a good high-beam light distribution pattern HP is obtained.

In so far as the vehicle headlamp 1 according to the sixth embodiment is concerned, a perpendicular sectional shape (a longitudinal sectional shape) of the mounting section 41 forms the shape as shown in FIG. 24. That is, the interior surface 410 that is a surface opposing to the semiconductor light source 2 of the mounting section 41 forms a concave surface which is recessed with respect to the semiconductor light source 2. In addition, the exterior surface 411 that is an opposite surface to the surface opposing to the semiconductor light source 2 of the mounting section 41 forms a convex surface which protrudes to the opposite side to the semiconductor light source 2. That is, the mounting section 41 forms a shape which is identical to a part of a tire shape and thus even if a thin shape is formed, this mounting section sufficiently has elasticity and rigidity. As a result, it is optimal to rotatably mount the mounting section 41 to the bearing member 7 by elastic engagement (snap-fit). Moreover, it is optimal to position the light control member 4 between the first location and the second location while a stopper 44 of the mounting section 41 abuts against a stopper 73 of the bearing member 7.

In so far as the vehicle headlamp 1 according to the sixth embodiment is concerned, a planar shape of the mounting section 41 forms a shape which is similar to a substantial arc shape, and the interior surface 410 forms a concave shape and the exterior surface 411 forms a convex shape. Thus, even if the light from the semiconductor light source 2 is made incident to the mounting section 41, the incident light transmits the mounting section in its transparent state as is, without any refraction, and thus, stray light is not generated. Moreover, the transmitted light from the mounting section 41 is shaded by the lens covering member 6 and thus the transmitted light is not emitted to the outside.

In so far as the vehicle headlamp 1 according to the sixth embodiment is concerned, the light control member 4 is composed of a light transmission member, and forms an integral structure. Thus, the light from the semiconductor light source 2 can be utilized through the variable focal point lens section 40, the fixed focal point lens section 45, and the gradually variable focal point lens section 46. That is, the light from the semiconductor light source 2 can be effectively utilized.

(Description of Examples Other than the Above Embodiments)

In the foregoing embodiments, the vehicle headlamp 1 in a case where the vehicle C is for left-side traffic is described. However, in the present invention, a vehicle headlamp in a case where the vehicle C is for right-side traffic can be applied as well.

In addition, in the foregoing embodiments, the main lens section 30 and the auxiliary lens section 31 of the lens 3 are integrated with each other. However, the main lens section 30 and the auxiliary lens section 31 of the lens 3 may be separated from each other.

Further, in the foregoing embodiments, the light control member 4 is rotated between the first location and the second location. However, in the present invention, the light control member 4 may be slid between the first location and the second location. In this case, sliding means is provided in place of a rotary shaft.

Furthermore, in the foregoing embodiments, the solenoid 50 is used as the drive member 5. However, in the present invention, a member other than the solenoid 50, for example, a motor or the like may be used as the drive member 5. In this case, between the motor and the light control member 4, a driving force transmission mechanism is provided.

Still furthermore, in the foregoing embodiments, the auxiliary lens section 31 of the lens 3 is a full reflection type lens section. However, in the present invention, the auxiliary lens section of the lens 3 may be a lens section other than the full reflection type lens section, for example, a reflection type lens section or a Fresnel type lens section.

Yet furthermore, in the foregoing embodiments, the first light distribution pattern is the low-beam light distribution pattern LP, and the second light distribution pattern is the high-beam light distribution pattern HP. However, in the present invention, as the first light distribution pattern, there may be a light distribution pattern other than the low-beam light distribution pattern LP, for example, a light distribution pattern which is emitted more downward than the horizontal line HL-HR from the left to the right of the screen in AFS or ADB or the like, and as the second light distribution pattern, there may be a light distribution pattern other than the high-beam light distribution pattern HP, for example, a light distribution pattern which is emitted more upward than the horizontal line HL-HR from the left to the right of the screen in AFS or ADB or the like.

Furthermore, in the fifth embodiment, the auxiliary lens section 31 is positioned at the lower side with respect to the main lens section 30, and the first location of the light control member 4 is set at the lower side and the focal point F40U of the upper portion 40U of the variable focal point lens section 40 is displaced to the lower side, and further, the focal point F40D of the lower portion 40D of the variable focal point lens section 40 is displaced to the upper side. However, in the present invention, it may be that the auxiliary lens section 31 is positioned at the lower side with respect to the main lens section 30, and the first location of the light control member 4 is set at the lower side, whereas the focal point F40U of the upper portion 40U of the variable focal point lens section 40 is displaced to the upper side, and further, the focal point F40D of the lower portion 40D of the variable focal point lens section 40 is displaced to the lower side.

Still furthermore, in the sixth embodiment, in the light control member 4, the gradually variable focal point lens section 46 is provided between the variable focal point lens section 40, and the fixed focal point lens section 45. However, in the present invention, the gradually variable focal point lens section 46 does not need to be provided at the light control member 4.

Yet furthermore, in the sixth embodiment, the light control member 4 is composed of a light transmission member, and forms an integral structure. However, in the present invention, the mounting section 41 may be optically non-transmissive.

Furthermore, in the sixth embodiment, a configuration is made such that, by the variable focal point lens section 40 of the light control member 4, a part of the low-beam light distribution pattern LP is deflected at the time of emission of the high-beam light distribution pattern HP, and by the fixed focal point lens section 45 of the light control member 4, the residual part of the low-beam light distribution pattern LP is disallowed to be deflected at the time of emission of the high-beam light distribution pattern HP. However, in the present invention, a configuration may be made such that, by the variable focal point lens section of the light control member, a part of the high-beam light distribution pattern is defected at the time of emission of the low-beam light distribution pattern, and by the fixed focal point lens section of the light control member, the residual part of the high-beam light distribution pattern is disallowed to be deflected at the emission of the low-beam light distribution pattern.

Still furthermore, in the sixth embodiment, there is used the light control member 4 in which the fixed focal point lens section 45 is provided between the variable focal point lens section 40 and the mounting section 41. However, in the present invention, there may be a case of using the light control member 4 in which the fixed focal point lens section 45 is not provided. In this case, at the time of emission of the high-beam light distribution pattern, the boundary between the portions at which the low-beam light distribution pattern is deflected and is not deflected at all become slightly unclear; and however, there is no problem in particular in terms of precision of the high-beam light distribution pattern.

DESCRIPTION OF REFERENCE NUMERALS

1 Vehicle headlamp
2 Semiconductor light source
20 Light emitting chip
21 Board
22 Connector
23 Light emission surface
3 Lens
30 Main lens section
300 Incidence surface of main lens section
301 Emission surface of main lens section
31 Auxiliary lens section
310 Incidence surface of auxiliary lens section
311 Reflection surface of auxiliary lens section
312 Emission surface of auxiliary lens section
32 Mounting section
4 Light control member
40 Variable focal point lens section
40C Intermediate portion
40D Lower portion
40U Upper portion
400 Incidence surface
401 Emission surface
41 Mounting section
410 Interior surface
411 Exterior surface
42 Elongated hole
43 Rotation hole
44 Stopper
45 Fixed focal point lens section
46 Gradually variable focal point lens section
5 Drive member
50 Solenoid
51 Connecting pin
52 Spring
53 Mounting section
54 Reciprocating rod
6 Lens covering member
60 Opening portion
61 Mounting section
7 Bearing member
70 Opening portion
71 Mounting section
72 Shaft part
73 Stopper
8 Base member
80 Light source mounting section
81 Lens mounting section
82 Base mounting section
9 Cooling member
C Vehicle
CL1 Lower horizontal cutoff line
CL2 Oblique cutoff line
CL3 Upper horizontal cutoff line
F Reference focal point of lens
F1 Pseudo focal point
F40C Focal point of intermediate portion
F40D Focal point of lower portion
F40U Focal point of upper portion
HL-HR Horizontal line from left to right of screen
HPF Fixed light distribution pattern
HPMF Combined light distribution pattern
HP, HPA High-beam light distribution pattern
HPM, HPMA Variable light distribution pattern
HPM1 First variable light distribution pattern
HPM2 Second variable light distribution pattern HPM3 Third variable light distribution pattern
HZ Hot zone
L1 Center light
L2 Another part of peripheral light
L3 Emitted light having been emitted from upper portion of variable focal point lens section
L4 Downward emitted light
L5 Upward emitted light
LP Low-beam light distribution pattern
MHP Main light distribution pattern of high-beam light distribution pattern
MLP Main light distribution pattern of low-beam light distribution pattern
O Center of light emission surface
O1 Rotation center
SHP Auxiliary light distribution pattern of high-beam light distribution pattern
SLP Auxiliary light distribution pattern of low-beam light distribution pattern
VU-VD Vertical line from top to bottom of screen
WD Lower opening portion
WU Upper opening portion
XX-axis
YY-axis
Z Reference optical axis of lens (Z-axis)
θ1, θ2 Rotation angle

The invention claimed is:

1. A vehicle headlamp comprising:
a semiconductor light source;
a lens arranged to emit light from the semiconductor light source toward a forward direction of a vehicle;
a light control member; and
a drive member configured to position the light control member to be switchable in movement between a first location and a second location,
wherein the lens includes a main lens section and an auxiliary lens section,
wherein, when the light control member is positioned in the first location, light to be incident into the auxiliary lens section from the semiconductor light source among the light from the semiconductor light source is subjected to light distribution control by the light control member so that the lens emits the light from the semiconductor type light source including the light subjected to the light distribution control by the light control member as a first light distribution pattern toward the forward direction of the vehicle, and
when the light control member is positioned in the second location, a predetermined portion of light to be incident into the main lens section from the semiconductor light source among the light from the semiconductor light source is subjected to light distribution control by the light control member so that the lens emits the light from the semiconductor type light source including the light subjected to the light distribution control by the light control member as a second light distribution pattern different from the first light distribution pattern toward the forward direction of the vehicle,
wherein the first light distribution pattern is a low-beam light distribution pattern (LP) provided by combining a main light distribution pattern (MLP) and an auxiliary light distribution pattern (SLP) of the low-beam light distribution pattern, the main light distribution pattern (MLP) of the low-beam light distribution pattern being emitted from the main lens section, and the auxiliary light distribution pattern (SLP) of the low-beam light distribution pattern being emitted from the auxiliary lens section to be positioned at a lower side more significantly than a lower horizontal cutoff line (CL1) of the low-beam light distribution pattern (LP), and
wherein the second light distribution pattern is a high-beam light distribution pattern (HP) provided by combining a main light distribution pattern (MHP) and an auxiliary light distribution pattern (SHP) of the high-beam light distribution pattern (HP), the main light distribution pattern (MHP) of the high-beam light distribution pattern (HP) being emitted from the main lens section, and the auxiliary light distribution pattern (SHP) of the high-beam light distribution pattern (HP) being emitted from the auxiliary lens section toward the central portion of the main light distribution pattern MHP of the high-beam light distribution pattern.

2. The vehicle headlamp according to claim 1, wherein
the light control member comprises a variable focal point lens section to displace, to an upper side, a focal point of the auxiliary lens section when positioned in the first location, with respect to a focal point of the auxiliary lens section when positioned in the second location.

3. The vehicle headlamp according to claim 1, wherein
the light control member rotates between the first location and the second location by way of the drive member, and
a rotation center of the light control member is behind a light emission surface of the semiconductor light source.

4. The vehicle headlamp according to claim 1, wherein
the auxiliary lens section is disposed at a lower side with respect to the main lens section.

5. The vehicle headlamp according to claim 4, wherein
the light control member that is positioned in the first location, and the auxiliary lens section partially overlap each other on top and bottom.

6. The vehicle headlamp according to claim 1, wherein
the first location is a location between the semiconductor light source and the auxiliary lens section, and the second location is a location between the semiconductor light source and the main lens section.

7. A vehicle headlamp comprising:
a semiconductor light source;
a lens arranged to emit light from the semiconductor light source toward a forward direction of a vehicle;
a light control member; and
a drive member configured to position the light control member to be switchable in movement between a first location and a second location,
wherein the lens includes a main lens section and an auxiliary lens section,
wherein, when the light control member is positioned in the first location, light to be incident into the auxiliary lens section from the semiconductor light source among the light from the semiconductor light source is subjected to light distribution control by the light control member so that the lens emits the light from the semiconductor type light source including the light subjected to the light distribution control by the light control member as a first light distribution pattern toward the forward direction of the vehicle, and
when the light control member is positioned in the second location, a predetermined portion of light to be incident into the main lens section from the semiconductor light source among the light from the semiconductor light source so that the lens emits the light from the semiconductor type light source including the light subjected to the light distribution control by the light control member as a second light distribution pattern different from the first light distribution pattern toward the forward direction of the vehicle, and wherein, the light control member is arranged such that when the light control member is positioned in the first location, a portion which is positioned at the main lens section's side, of the light control member, displaces a focal point of the main lens section to a lower side, wherein the first light distribution pattern is a low-beam light distribution pattern (LP) provided by combining a main light distribution pattern (MLP) and an auxiliary light distribution pattern (SLP) of the low-beam light distribution pattern, the main light distribution pattern (MLP) of the low-beam light distribution pattern being emitted from the main lens section, and the auxiliary light distribution pattern (SLP) of the low-beam light distribution pattern being emitted from the auxiliary lens section to be positioned at a lower side more significantly than a lower horizontal cutoff line (CL1) of the low-beam light distribution pattern (LP), and wherein the second light distribution pattern is a high-beam light distribution pattern (HP) provided by combining a main light distribution pattern (MHP) and an auxiliary light distribution pattern (SHP) of the high-beam light distribution pattern (HP), the main light distribution pattern (MHP) of the high-beam light distribution pattern (HP) being emitted from the main lens section, and the auxiliary light distribution pattern (SHP) of the high-beam light distribution pattern (HP) being emitted from the auxiliary lens section toward the central portion of the main light distribution pattern MHP of the high-beam light distribution pattern.

8. The vehicle headlamp according to claim 7, wherein the light control member rotates between the first location and the second location by way of the drive member, and a rotation center of the light control member is behind a light emission surface of the semiconductor light source.

9. The vehicle headlamp according to claim 7, wherein the auxiliary lens section is disposed at a lower side with respect to the main lens section.

10. The vehicle headlamp according to claim 7, wherein the light control member that are positioned in the first location, and the auxiliary lens section partially overlap each other on top and bottom.

11. The vehicle headlamp according to claim 7, wherein the first location is a location between the semiconductor light source and the auxiliary lens section, and the second location is a location between the semiconductor light source and the main lens section.

12. A vehicle headlamp comprising:

a semiconductor light source;

a lens arranged to emit light from the semiconductor light source toward a forward direction of a vehicle;

a light control member; and a drive member configured to position the light control member to be switchable in movement between a first location and a second location, wherein the lens includes a main lens section and an auxiliary lens section, wherein, when the light control member is positioned in the first location, light to be incident into the auxiliary lens section from the semiconductor light source among the light from the semiconductor light source is subjected to light distribution control by the light control member so that the lens emits the light from the semiconductor type light source including the light subjected to the light distribution control by the light control member as a first light distribution pattern toward the forward direction of the vehicle, and when the light control member is positioned in the second location, a predetermined portion of light to be incident into the main lens section from the semiconductor light source among the light from the semiconductor light source so that the lens emits the light from the semiconductor type light source including the light subjected to the light distribution control by the light control member as a second light distribution pattern different from the first light distribution pattern to the forward direction of the vehicle, wherein a focal point of an upper portion of the light control member is displaced to an upper side or a lower side with respect to a focal point of another portion, and wherein a focal point of a lower portion of the light control member is displaced to a lower side or an upper side with respect to the focal point of another portion, wherein the first light distribution pattern is a low-beam light distribution pattern (LP) provided by combining a main light distribution pattern (MLP) and an auxiliary light distribution pattern (SLP) of the low-beam light distribution pattern, the main light distribution pattern (MLP) of the low-beam light distribution pattern being emitted from the main lens section, and the auxiliary light distribution pattern (SLP) of the low-beam light distribution pattern being emitted from the auxiliary lens section to be positioned at a lower side more significantly than a lower horizontal cutoff line (CL1) of the low-beam light distribution pattern (LP), and wherein the second light distribution pattern is a high-beam light distribution pattern (HP) provided by combining a main light distribution pattern (MHP) and an auxiliary light distribution pattern (SHP) of the high-beam light distribution pattern (HP), the main light distribution pattern (MHP) of the high-beam light distribution pattern (HP) being emitted from the main lens section, and the auxiliary light distribution pattern (SHP) of the high-beam light distribution pattern (HP) being emitted from the auxiliary lens section toward the central portion of the main light distribution pattern MHP of the high-beam light distribution pattern.

13. The vehicle headlamp according to claim 12, wherein a focal point of an intermediate portion between upper and lower sides of the light control member is neither displaced to the upper side nor the lower side.

14. The vehicle headlamp according to claim 12, wherein of the light control member, when positioned in the first location, a focal point of a portion which is at an optical axis's side of the main lens section is displaced to a lower side with respect to a focal point of another portion, and of the light control member, when positioned in the first location, a focal point of a portion opposite to the optical axis's side of the main lens section is displaced to an upper side with respect to the focal point of said another portion.

15. The vehicle headlamp according to claim 12, wherein the light control member rotates between the first location and the second location by way of the drive member, and a rotation center of the light control member is behind a light emission surface of the semiconductor light source.

16. The vehicle headlamp according to claim 12, wherein the auxiliary lens section is disposed at a lower side with respect to the main lens section.

17. The vehicle headlamp according to claim 16, wherein the light control member that is positioned in the first location, and the auxiliary lens section partially overlap each other on top and bottom.

18. The vehicle headlamp according to claim 12, wherein the first location is a location between the semiconductor light source and the auxiliary lens section, and the second location is a location between the semiconductor light source and the main lens section.

19. A vehicle headlamp comprising:

a semiconductor light source;

a lens arranged to emit light from the semiconductor light source toward a forward direction of a vehicle;

a light control member; and a drive member to position the light control member to be switchable in movement between a first location and a second location, wherein the lens includes a main lens section and an auxiliary lens section, wherein, when the light control member is positioned in the first location, light to be incident into the auxiliary lens section from the semiconductor light source among the light from the semiconductor light source is subjected to light distribution control by the light control member so that the lens emits the light from the semiconductor type light source including the light subjected to the light distribution control by the light control member as a first light distribution pattern toward the forward direction of the vehicle, and when the light control member is positioned in the second location, a predetermined portion of light to be incident into the main lens section from the semiconductor light source among the light from the semiconductor light source is subjected to light distribution control by the light control member so that the lens emits the light from the semiconductor type light source including the light subjected to the light distribution control by the light control member as a second light distribution pattern different from the first light distribution pattern to the forward direction of the vehicle, and wherein the light control member is composed of a light transmission member, and comprises a variable focal point lens and a mounting section, wherein the first light distribution pattern is a low-beam light distribution pattern (LP) provided by combining a main light distribution pattern (MLP) and an auxiliary light distribution pattern (SLP) of the low-beam light distribution pattern, the main light distribution pattern (MLP) of the low-beam light distribution pattern being emitted from the main lens section, and the auxiliary light distribution pattern (SLP) of the low-beam light distribution pattern being emitted from the auxiliary lens section to be positioned at a lower side more significantly than a lower horizontal cutoff line (CL1) of the low-beam light distribution pattern (LP), and wherein the second light distribution pattern is a high-beam light distribution pattern (HP) provided by combining a main light distribution pattern (MHP) and an auxiliary light distribution pattern (SHP) of the high-beam light distribution pattern (HP), the main light distribution pattern (MHP) of the high-beam light distribution pattern (HP) being emitted from the main lens section, and the auxiliary light distribution pattern (SHP) of the high-beam light distribution pattern (HP) being emitted from the auxiliary lens section toward the central portion of the main light distribution pattern MHP of the high-beam light distribution pattern.

20. The vehicle headlamp according to claim 19, wherein between the variable focal point lens section and the mounting section, a fixed focal point lens section is provided.

21. The vehicle headlamp according to claim 20, wherein between the variable focal point lens section and the fixed focal point lens section, a gradually variable focal point lens section is provided.

22. The vehicle headlamp according to claim 19, wherein of the light control member, at least a surface opposing to the semiconductor light source of the mounting section forms a concave surface which is recessed with respect to the semiconductor light source, and at least an opposite surface to the surface opposing to the semiconductor light source of the mounting section forms a convex surface which protrudes to an opposite side to the semiconductor light source.

23. The vehicle headlamp according to claim 19, wherein the first location is a location between the semiconductor light source and the auxiliary lens section, and the second location is a location between the semiconductor light source and the main lens section.

* * * * *